US011701697B2

(12) United States Patent
Niitani et al.

(10) Patent No.: US 11,701,697 B2
(45) Date of Patent: Jul. 18, 2023

(54) COOLING DEVICE FOR HOT-ROLLED STEEL SHEET AND COOLING METHOD OF HOT-ROLLED STEEL SHEET

(71) Applicant: NIPPON STEEL CORPORATION, Tokyo (JP)

(72) Inventors: Hiroshi Niitani, Tokyo (JP); Nobumasa Hayashi, Tokyo (JP); Rumi Matsumoto, Tokyo (JP); Yoshihiro Serizawa, Tokyo (JP); Tomofumi Hosho, Tokyo (JP); Takumu Ushizawa, Tokyo (JP); Naoko Katou, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 211 days.

(21) Appl. No.: 17/275,511

(22) PCT Filed: Sep. 10, 2019

(86) PCT No.: PCT/JP2019/035581
§ 371 (c)(1),
(2) Date: Mar. 11, 2021

(87) PCT Pub. No.: WO2020/059577
PCT Pub. Date: Mar. 26, 2020

(65) Prior Publication Data

US 2022/0032352 A1 Feb. 3, 2022

(30) Foreign Application Priority Data

Sep. 19, 2018 (JP) ..... JP2018-174870

(51) Int. Cl.
*B21B 45/02* (2006.01)
*B21B 39/14* (2006.01)
*B21B 37/74* (2006.01)

(52) U.S. Cl.
CPC ..... *B21B 45/0218* (2013.01); *B21B 37/74* (2013.01); *B21B 39/14* (2013.01); *B21B 45/0233* (2013.01)

(58) Field of Classification Search
CPC ..... B21B 45/0218; B21B 37/74; B21B 39/14; B21B 45/0233; B21B 38/006; C21D 1/667; C21D 8/0263
(Continued)

(56) References Cited

U.S. PATENT DOCUMENTS 7,718,018 B2 * 5/2010 Serizawa ..... B21B 37/74 148/656
8,359,894 B2 * 1/2013 Yoshii ..... B21B 37/76 72/12.2

(Continued)

FOREIGN PATENT DOCUMENTS

JP 6-71328 A 3/1994
JP 2010-527797 A 8/2010

(Continued)

*Primary Examiner* — Scott R Kastler
*Assistant Examiner* — Michael Aboagye
(74) *Attorney, Agent, or Firm* — Birch, Steward, Kolasch & Birch, LLP

(57) ABSTRACT

The present cooling device includes: when cooling regions obtained by dividing an entire cooling region into a plurality of portions in a steel sheet conveyance direction and three or more portions in a width direction are set as divided cooling surfaces, a cooling water nozzle 23 and a switching device that switches between collision and non-collision of cooling water jetted from the cooling water nozzle 23 with the divided cooling surface, the cooling water nozzle 23 and the switching device provided for each of the divided cooling surfaces; and a control device that controls operation of the switching device based on a width-direction temperature distribution. The cooling water nozzle 23 has a jet axis P inclined with respect to a vertical line to the entire cooling (Continued)

region when viewed in the steel sheet conveyance direction, and the cooling water goes to the side opposite to the cooling water nozzle 23 in the width direction after colliding with the divided cooling surface.

20 Claims, 22 Drawing Sheets

(58) Field of Classification Search
USPC ..... 266/46, 259, 113
See application file for complete search history.

(56) References Cited

U.S. PATENT DOCUMENTS

| | | | | |
|---|---|---|---|---|
| 8,404,062 | B2 * | 3/2013 | Ueoka | C21D 9/46 148/657 |
| 8,634,953 | B2 * | 1/2014 | Soderlund | C21D 9/5732 72/8.2 |
| 9,180,504 | B2 * | 11/2015 | Baumgärtel | B21B 45/0233 |
| 10,350,659 | B2 * | 7/2019 | Hayashi | B21B 37/76 |
| 11,148,182 | B2 * | 10/2021 | Haraguchi | B21B 45/0233 |
| 2009/0121396 | A1 | 5/2009 | Serizawa et al. | |
| 2010/0132426 | A1 | 6/2010 | Baumgärtel et al. | |
| 2011/0208345 | A1 | 8/2011 | Soderlund | |
| 2017/0189949 | A1 | 7/2017 | Duhoux et al. | |
| 2018/0290193 | A1 | 10/2018 | Hayashi et al. | |

FOREIGN PATENT DOCUMENTS

| | | | |
|---|---|---|---|
| JP | 2011-51002 | A | 3/2011 |
| WO | WO 2008/035510 | A1 | 3/2008 |
| WO | WO 2009/024644 | A1 | 2/2009 |
| WO | WO 2018/073973 | A1 | 4/2018 |

* cited by examiner (A)

(B)

(A)

(B)

(A)

(B)

(A)

(B)

(A)

(B)

COOLING DEVICE FOR HOT-ROLLED STEEL SHEET AND COOLING METHOD OF HOT-ROLLED STEEL SHEET

TECHNICAL FIELD

The present invention relates to a cooling device that cools a top surface of a hot-rolled steel sheet being conveyed on conveyor rolls after hot rolling and a cooling method using the cooling device.

BACKGROUND ART

As the weight of automobiles has been reduced in recent years, the demand for high tensile steel sheets among hot-rolled steel sheets has been increasing, and the quality required of hot-rolled steel sheets has become even higher. In recent years in particular, in addition to high strength, excellent workability, such as press formability or hole expandability, is required, and variations in mechanical properties such as tensile strength and workability are required to be kept within predetermined ranges over the entire region of the steel sheet.

In the manufacturing process of the hot-rolled steel sheet, one of the factors greatly affecting the above properties of a final product is a coiling temperature. Here, the coiling temperature is the temperature of the steel sheet immediately before a coiling device where the steel sheet is coiled after a cooling step following finish rolling.

In general, in a cooling step, in which cooling water is jetted to a hot-rolled steel sheet at high temperature of 800° C. to 900° C., which has undergone finish rolling, steam generated by film boiling stably covers the surface of the steel sheet during the time when the temperature of the steel sheet is about 600° C. or more. Therefore, although a cooling capacity by the cooling water itself becomes small, uniform cooling of the entire surface of the steel sheet is facilitated relatively.

However, when the temperature of the steel sheet is below 600° C. in particular, the amount of steam to be generated decreases as the temperature of the steel sheet decreases. Then, a steam film covering the surface of the steel sheet starts to break, and a transition boiling region in which the distribution of the steam film changes temporally and spatially is made. As a result, the nonuniformity in cooling increases and the nonuniformity in temperature distribution of the steel sheet is likely to expand rapidly. This makes it difficult to control the temperature of the steel sheet and to finish cooling the entire steel sheet at a desired coiling temperature.

In the meantime, in order to produce a product having excellent properties in which strength and workability are both achieved, it is effective to lower the coiling temperature to a low-temperature region of 500° C. or less. Therefore, it is important to make the nonuniformity of the coiling temperature over the entire steel sheet fall within a predetermined range in response to a target temperature. From this point of view, many inventions have been made for the uniformity of the coiling temperature, particularly, the uniformity of the coiling temperature in the sheet width direction.

Patent Document 1 discloses that in a cooling device, a plurality of nozzles for adding a cooling medium to a hot-rolled steel sheet are installed in a width direction on both upper and lower sides of the hot-rolled steel sheet and these nozzles are controlled in such a way that the cooling medium is added to positions where a particularly elevated temperature can be detected. A plurality of temperature sensors are further installed in the cooling device in the width direction, and it is configured that these temperature sensors detect a temperature distribution of the hot-rolled steel sheet in the width direction, and the amount of the cooling medium from the nozzles can be controlled based on signals of the temperature sensors.

Patent Document 2 discloses that in a cooling device, a plurality of cooling water headers having a plurality of cooling water supply nozzle groups aligned in a linear pattern are arranged above and in a width direction of a hot-rolled steel sheet, and a cooling water flow rate is controlled based on a temperature distribution measured by a temperature distribution sensor that detects a temperature distribution in the sheet width direction. Concretely, these cooling water headers are provided with on-off control valves, and the cooling water is controlled by the on-off control valves.

In a cooling device disclosed in Patent Document 3, when a region on conveyor rolls occupied by a hot-rolled steel sheet is set as a steel sheet conveyance region, a pair of spray nozzles to jet cooling water to the steel sheet conveyance region in a width direction of the steel sheet conveyance region is arranged on both lateral sides of the steel sheet conveyance region in the width direction, and a plurality of the spray nozzle pairs are aligned in a conveyance direction of the hot-rolled steel sheet. In this cooling device, in regard to a collision region of cooling water jetted from the spray nozzle at the steel sheet conveyance region, a far end in a jetting direction is located at an end of the conveyance region, and a near end is located on an inner side of the steel sheet conveyance region, and the near ends of two collision regions of the spray nozzle pair coincide in the width direction to form a meeting. Further, Patent Document 3 discloses that the above-described meetings are arranged in a staggered pattern in a meeting zone marked off at the middle of the steel sheet conveyance region in the width direction, and therefore, the meetings are dispersed in the width direction and a portion subjected to overcooling is minimized, and consequently, the hot-rolled steel sheet is cooled uniformly in the width direction.

Patent Document 4 discloses that in a cooling facility that is installed in a hot-rolled steel sheet manufacturing line to supply cooling water to a top surface and an under surface of a steel sheet that has undergone finish rolling, headers supplying cooling water to the top surface of the steel sheet that has undergone finish rolling are composed of normal cooling headers and strong cooling headers. The normal cooling headers are located directly above the steel sheet and supply cooling water at a flow density of 0.5 to 2.0 $m^3/m^2$ min. The strong cooling headers are located above the outer side of the steel sheet in the width direction and supply bar-shaped cooling water with a flow density of 2.0 to 10.0 $m^3/m^2$ min downward to the inner side in the width direction to prevent the cooling water after landing on the steel sheet from staying on the steel sheet.

PRIOR ART DOCUMENT

Patent Document

[Patent Document 1] Japanese Translation of PCT International Application Publication No. 2010-527797

[Patent Document 2] Japanese Laid-open Patent Publication No. 06-71328

[Patent Document 3] International Publication Pamphlet No. WO 2018/073973

[Patent Document 4] Japanese Laid-open Patent Publication No. 2011-51002

DISCLOSURE OF THE INVENTION

Problems to be Solved by the Invention

However, Patent Documents 1 and 2 do not disclose the cooling control of a hot-rolled steel sheet in the steel sheet conveyance direction, and it is difficult in the cooling devices in Patent Document 1 and 2 to suppress the non-uniform temperature distribution of the hot-rolled steel sheet in the steel sheet conveyance direction.

Further, in the cooling device in Patent Document 1, as described previously, the nozzles for adding a cooling medium to the hot-rolled steel sheet are installed above the hot-rolled steel sheet, so that in the case where cooling water is used as the cooling medium, the temperature of the hot-rolled steel sheet in the width direction cannot be controlled sufficiently because of the presence of water on the top surface of the hot-rolled steel sheet for a long time. The cooling device in Patent Document 2, namely the cooling device in which the cooling water headers having the cooling water supply nozzle groups aligned in a linear pattern as described previously are arranged above the hot-rolled steel sheet, is also the same as the cooling device in Patent Document 1.

In the cooling device disclosed in Patent Document 3, the spray nozzles jet cooling water to the steel sheet conveyance region in the width direction to cool the hot-rolled steel sheet while draining the water on the sheet, and further, the near ends of the two collision regions of the spray nozzle pair coincide in the width direction to form the meeting and the meetings are arranged in a staggered pattern to suppress the overcooling, and however, the meetings are arranged in the meeting zone marked off at the middle of the steel sheet conveyance region in the width direction and are not arranged in the entire width direction. Accordingly, in the cooling device disclosed in Patent Document 3, there is room for improvement in terms of the uniform cooling of the full width in the width direction. Further, Patent Document 3 also does not disclose the cooling control of the hot-rolled steel sheet in the steel sheet conveyance direction.

Further, the strong cooling headers disclosed in Patent Document 4 supply bar-shaped cooling water downward to the inner side in the width direction to prevent the cooling water after landing on the steel sheet from staying on the steel sheet, but there is created a gap between a collision region of the cooling water from the above-described header nozzle in the steel sheet and another collision region adjacent thereto in the width direction because the bar-shaped cooling water is employed. At the position corresponding to this gap, the cooling of the steel sheet becomes insufficient, and thus, the cooling device disclosed in Patent Document 4 fails to perform uniform cooling in the width direction. Further, Patent Document 4 also does not disclose the cooling control of the hot-rolled steel sheet in the steel sheet conveyance direction.

The present invention has been made in consideration of the above-described circumstances, and has an object thereof to improve the uniformity of temperatures in a steel sheet conveyance direction and a width direction of a hot-rolled steel sheet by appropriately cooling a top surface of the hot-rolled steel sheet after hot rolling.

Means for Solving the Problems

The present invention to solve the above-described problems is a cooling device for a hot-rolled steel sheet that cools a top surface of a hot-rolled steel sheet being conveyed on conveyor rolls after hot rolling, the cooling device including: when of a top surface of a cooling target region, a region demarcated by a cooling machine length and a full width in a width direction, or a region obtained by excluding a non-cooling region in a middle portion in the width direction from the demarcated region is set as an entire cooling region, regions obtained by dividing the entire cooling region into three or more portions in the width direction are set as width-divided cooling zones, and regions obtained by dividing the width-divided cooling zone into a plurality of portions in a machine length direction are set as divided cooling surfaces, at least one cooling water nozzle that jets cooling water to each of the divided cooling surfaces to form a cooling water collision region on the top surface of the cooling target region and a switching device that switches between collision and non-collision of the cooling water jetted from the cooling water nozzle with the divided cooling surface, the cooling water nozzle and the switching device provided for each of the divided cooling surfaces; a temperature detecting device that measures a width-direction temperature distribution of the cooling target region; and a control device that controls operation of the switching device corresponding to each of a plurality of the divided cooling surfaces contained in the width-divided cooling zone for each of the width-divided cooling zones based on measurement results of the width-direction temperature distribution by the temperature detecting device, to thereby control cooling for the entire length of the width-divided cooling zone, and controls cooling of the entire cooling region with these controls together, in which the single cooling water collision region overlaps the another cooling water collision region adjacent thereto in the width direction in the entire cooling region to form a cooling water collision region group in which the cooling water collision regions are connected in the width direction, each of the cooling water collision region groups does not overlap the another cooling water collision region group, the full width of the entire cooling region in the width direction is covered with the single cooling water collision region group or a pair of the cooling water collision region groups adjacent to each other in the machine length direction, and the cooling water nozzles forming the single cooling water collision region group have a jet axis inclined with respect to a vertical line to the top surface of the cooling target region when viewed in the machine length direction, and none of the cooling water nozzles forming the single cooling water collision group has the jet axis inclined in the opposite direction when viewed in the machine length direction.

The non-cooling region does not need to be present.

A width of a region in the width direction where the cooling water collision region overlaps the another cooling water collision region adjacent in the width direction may be 5% or more of a width of the single cooling water collision region in the width direction.

An inclination angle of the jet axis of the cooling water nozzle may be 10° to 45°.

The jet axis of the cooling water nozzle does not need to be inclined in the machine length direction.

The cooling water collision region may overlap a center axis of the conveyor roll in plan view.

The cooling water nozzle may be provided to make the center of the cooling water collision region located on the center axis of the conveyor roll in plan view.

The cooling water nozzle may be provided above or on the lateral side of the cooling target region when viewed in the machine length direction.

When the cooling water collision region group formed by the cooling water nozzles that jet cooling water to one side in the width direction is set as a first cooling water collision region group, and the cooling water collision region group formed by the cooling water nozzles that jet cooling water to the other side in the width direction is set as a second cooling water collision region group, the cooling water nozzles may be provided so that the first cooling water collision region group and the second cooling water collision region group are both formed and the boundary between the first cooling water collision region group and the second cooling water collision region group in the width direction is located in the middle of the cooling target region in the width direction.

A draining nozzle that jets draining water to form a draining water collision region may be provided, on the top surface of the cooling target region, in each region on the downstream side of each of the cooling water collision region groups in the machine length direction, or in a region in the machine length direction downstream from, out of the cooling water collision region groups, the region group on the most downstream side in the machine length direction.

The present invention according to another aspect is a cooling method of a hot-rolled steel sheet that uses a cooling device to cool a top surface of a hot-rolled steel sheet being conveyed on conveyor rolls after hot rolling, in which when of a top surface of a cooling target region, a region demarcated by a cooling machine length and a full width in a width direction, or a region obtained by excluding a non-cooling region in a middle portion in the width direction from the demarcated region is set as an entire cooling region, regions obtained by dividing the entire cooling region into three or more portions in the width direction are set as width-divided cooling zones, and regions obtained by dividing the width-divided cooling zone into a plurality of portions in a machine length direction are set as divided cooling surfaces, the cooling device includes: for each of the divided cooling surfaces, at least one cooling water nozzle that jets cooling water to the divided cooling surface to form a cooling water collision region on the top surface of the cooling target region, the single cooling water collision region overlaps the another cooling water collision region adjacent thereto in the width direction in the entire cooling region to form a cooling water collision region group in which the cooling water collision regions are connected in the width direction, each of the cooling water collision region groups does not overlap the another cooling water collision region group, the full width of the entire cooling region in the width direction is covered with the single cooling water collision region group or a pair of the cooling water collision region groups adjacent to each other in the machine length direction, and the cooling water nozzles forming the single cooling water collision region group have a jet axis inclined with respect to a vertical line to the top surface of the cooling target region when viewed in the machine length direction, and none of the cooling water nozzles forming the single cooling water collision group has the jet axis inclined in the opposite direction when viewed in the machine length direction, the cooling method including: measuring a width-direction temperature distribution of the cooling target region; controlling, for each of the width-divided cooling zones, collision and non-collision of cooling water from the cooling water nozzle with each a plurality of the divided cooling surfaces contained in the width-divided cooling zone based on measurement results of the width-direction temperature distribution of the cooling target region, thereby controlling cooling for the entire length of the width-divided cooling zone in the machine length direction, and controlling cooling of the entire cooling region; and letting cooling water jetted from the cooling water nozzle go to the side opposite to the cooling water nozzle in the width direction to drain the cooling water.

The cooling method of the hot-rolled steel sheet may further include: jetting draining water to form a draining water collision region, on the top surface of the cooling target region, in each region on the downstream side of each of the cooling water collision region groups in the machine length direction, or in a region in the machine length direction downstream from, out of the cooling water collision region groups, the region group on the most downstream side in the machine length direction.

Effect of the Invention

According to the present invention, the top surface of the hot-rolled steel sheet is cooled appropriately after hot rolling, thereby making it possible to improve the uniformity of temperatures in the steel sheet conveyance direction and the width direction of the hot-rolled steel sheet.

MODE FOR CARRYING OUT THE INVENTION

Figure 1:
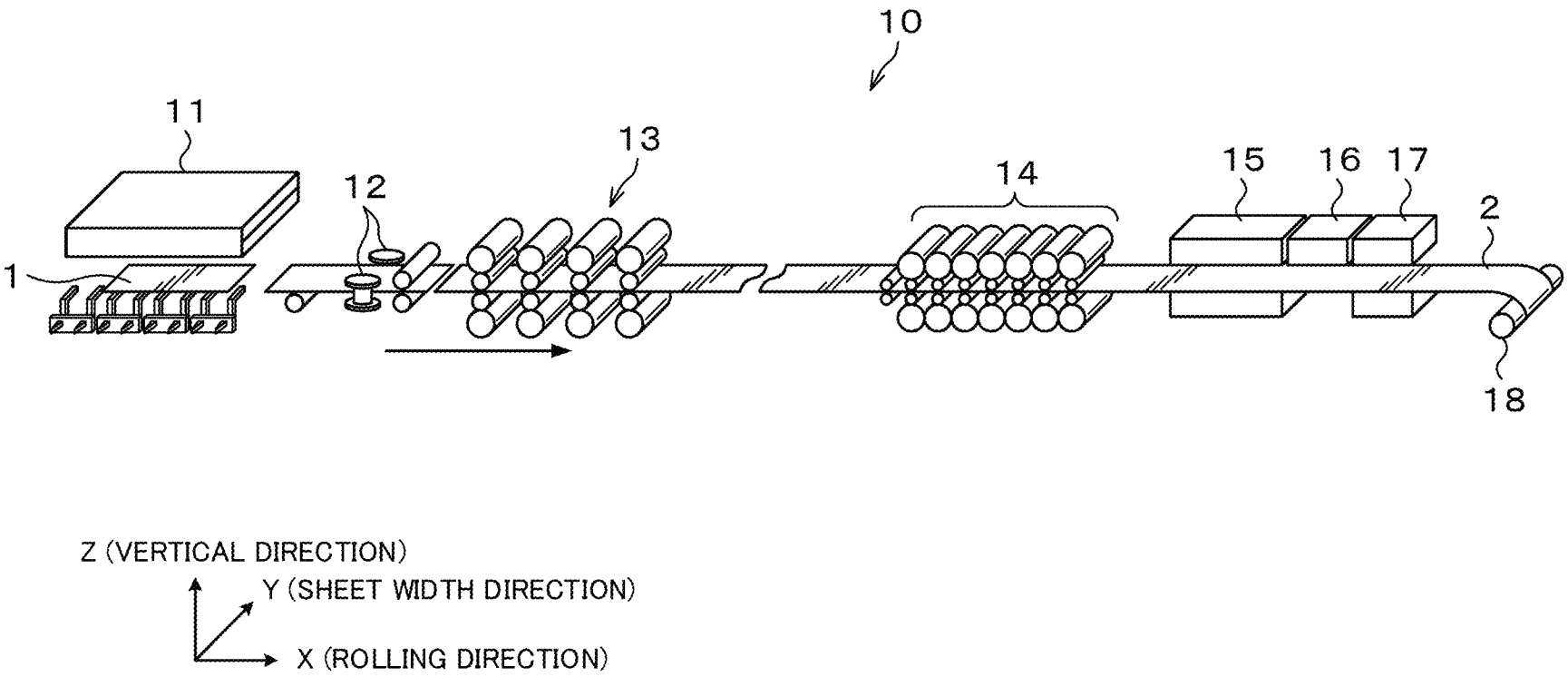
FIG. 1 is an explanatory view illustrating an outline of a configuration of a hot rolling facility 10 according to a first embodiment of the present invention.

As a result of repeated earnest examinations, the present inventors learned the following findings. That is, they learned that in the case where cooling water nozzles are provided above a hot-rolled steel sheet, jet axes of the cooling water nozzles are inclined to let cooling water from the cooling water nozzles go to the side in the width direction (hereinafter, the width direction is sometimes referred to as a sheet width direction or a machine width direction, but both are the same in meaning) opposite to the cooling water nozzles after colliding with the hot-rolled steel sheet and let the cooling water flow down from the hot-rolled steel sheet, and thereby between a region that is directly cooled by the cooling water from the cooling water nozzles and a region that is cooled by water staying on the sheet until it flows down after colliding with the hot-rolled steel sheet, a heat transfer coefficient of the former region is about four times greater than that of the latter region. From this examination result, they learned that the cooling water nozzles whose jet axes are inclined are provided for each of divided cooling surfaces obtained by dividing a top surface of a cooling target region in the width direction and the steel sheet conveyance direction (hereinafter the steel sheet conveyance direction is sometimes referred to as a machine length direction, but both are the same in meaning), and by switching between collision and non-collision of the cooling water jetted from the cooling water nozzles with the divided cooling surface based on a measurement result of a width-direction temperature distribution, the uniformity of temperatures in the hot-rolled steel sheet conveyance direction and the width direction can be improved.

Embodiments of the present invention will be hereinafter explained with reference to the drawings. Note that, in the description and the drawings, components having substantially the same function and configuration are denoted by the same reference numerals and symbols, and a redundant explanation will be thereby omitted.

First Embodiment

FIG. 1 is an explanatory view illustrating an outline of a configuration of a manufacturing apparatus 10 of a hot-rolled steel sheet (to be referred to as a "hot rolling facility" below) provided with a cooling device in a first embodiment of the present invention.

As illustrated in FIG. 1, in the hot rolling facility 10, a heated slab 1 is continuously rolled by being sandwiched between upper and lower rolls, and the slab is thinned to a minimum sheet thickness of about 1 mm and is coiled as a hot-rolled steel sheet 2. The hot rolling facility 10 includes: a heating furnace 11 for heating the slab 1; a width-direction mill 12 that rolls the slab 1 heated by the heating furnace 11 in the sheet width direction; a roughing mill 13 that rolls the slab 1 rolled in the sheet width direction from up and down directions to make it into a rough bar; a finishing mill 14 that further continuously hot rolls the rough bar to a predetermined thickness; cooling devices 15, 16, and 17 that cool the hot-rolled steel sheet 2 hot-rolled by the finishing mill 14 by cooling water; and a coiling device 18 that coils the hot-rolled steel sheet 2 cooled by the cooling devices 15, 16, and 17 into a coil shape.

In the heating furnace 11, the slab 1 brought in from the outside through a charging hole is heated to a predetermined temperature. After the heating in the heating furnace 11 is finished, the slab 1 is extracted out of the heating furnace 11 and conveyed through the width-direction mill 12 to a rolling step by the roughing mill 13.

In the rough rolling step, the slab 1 is rolled by the roughing mill 13 into a rough bar (sheet bar) to a thickness of, for example, about 30 mm to 60 mm to be conveyed to the finishing mill 14.

In the finishing mill 14, the conveyed rough bar is rolled to a sheet thickness of about several millimeters (for example, 1 to 15 mm) to form the hot-rolled steel sheet 2. The rolled hot-rolled steel sheet 2 is conveyed by conveyor rolls 19 (see FIG. 2 and FIG. 3) to be first conveyed to a cooling zone made by the main cooling device 15, and further conveyed to a cooling zone made by the upper width-direction control cooling device (to be referred to as the "upper cooling device" below) 16, and further conveyed to a cooling zone made by the adjustment cooling device 17.

The hot-rolled steel sheet 2 is cooled by the above-described main cooling device 15, upper cooling device 16, and adjustment cooling device 17 to be coiled into a coil shape by the coiling device 18. Among the cooling devices 15, 16, and 17, the main cooling device 15 mainly cools the hot-rolled hot-rolled steel sheet 2, the upper cooling device 16 cools the hot-rolled steel sheet 2 from the top surface side so as to solve the nonuniformity of temperatures in the width direction of the hot-rolled steel sheet 2 cooled by the main cooling device 15, and the adjustment cooling device 17 cools the hot-rolled steel sheet 2 cooled by the upper cooling device 16 to a target temperature. Incidentally, the main cooling device 15 and the adjustment cooling device 17 are arranged so as to sandwich the hot-rolled steel sheet 2 being conveyed on a run out table from above and below, and the upper cooling device 16 is arranged above the hot-rolled steel sheet 2. Further, the adjustment cooling device 17 cools the hot-rolled steel sheet 2 so as to lower its temperature by about 50° C., for example.

The configuration of the main cooling device 15 is not limited in particular, and a well-known cooling device can be applied. For example, the main cooling device 15 includes: a plurality of cooling water nozzles that jet cooling water vertically downward to the top surface of the hot-rolled steel sheet 2 from above the hot-rolled steel sheet 2 being conveyed on the conveyor rolls 19 of the run out table; and a plurality of cooling water nozzles that jet cooling water vertically upward to the under surface of the hot-rolled steel sheet 2 from below the hot-rolled steel sheet 2. As the cooling water nozzle, for example, slit-laminar nozzles, pipe laminar nozzles, or the like are used.

In the example in the drawings, a lower cooling device that cools the hot-rolled steel sheet 2 from the under surface side is not provided at a position facing the upper cooling device 16, but the lower cooling device may be provided. The configuration of the lower cooling device is not limited in particular, and a well-known cooling device can be applied. For example, as the lower cooling device, the cooling device in International Publication Pamphlet No. WO 2018/179449 can be installed.

Further, the configuration of the adjustment cooling device 17 is also not limited in particular, and a well-known cooling device can be applied. In the case where the coolings by up to the upper cooling device 16 do not result in a cooling deficit, the adjustment cooling device 17 is not necessarily arranged, but is usually required.

Figure 2:
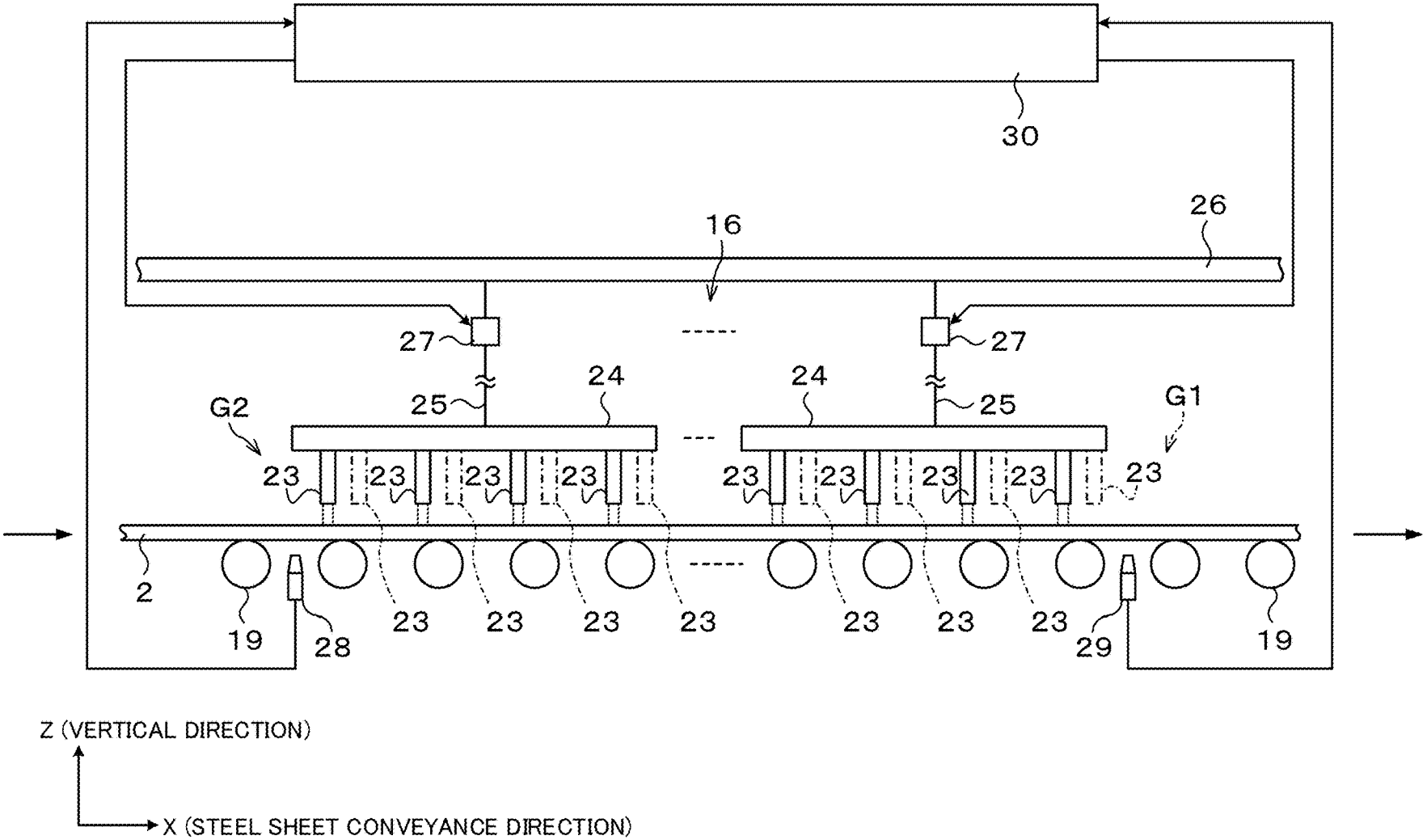
FIG. 2 is a side view illustrating an outline of a configuration of an upper width-direction control cooling device 16 according to the first embodiment of the present invention.
Figure 3:
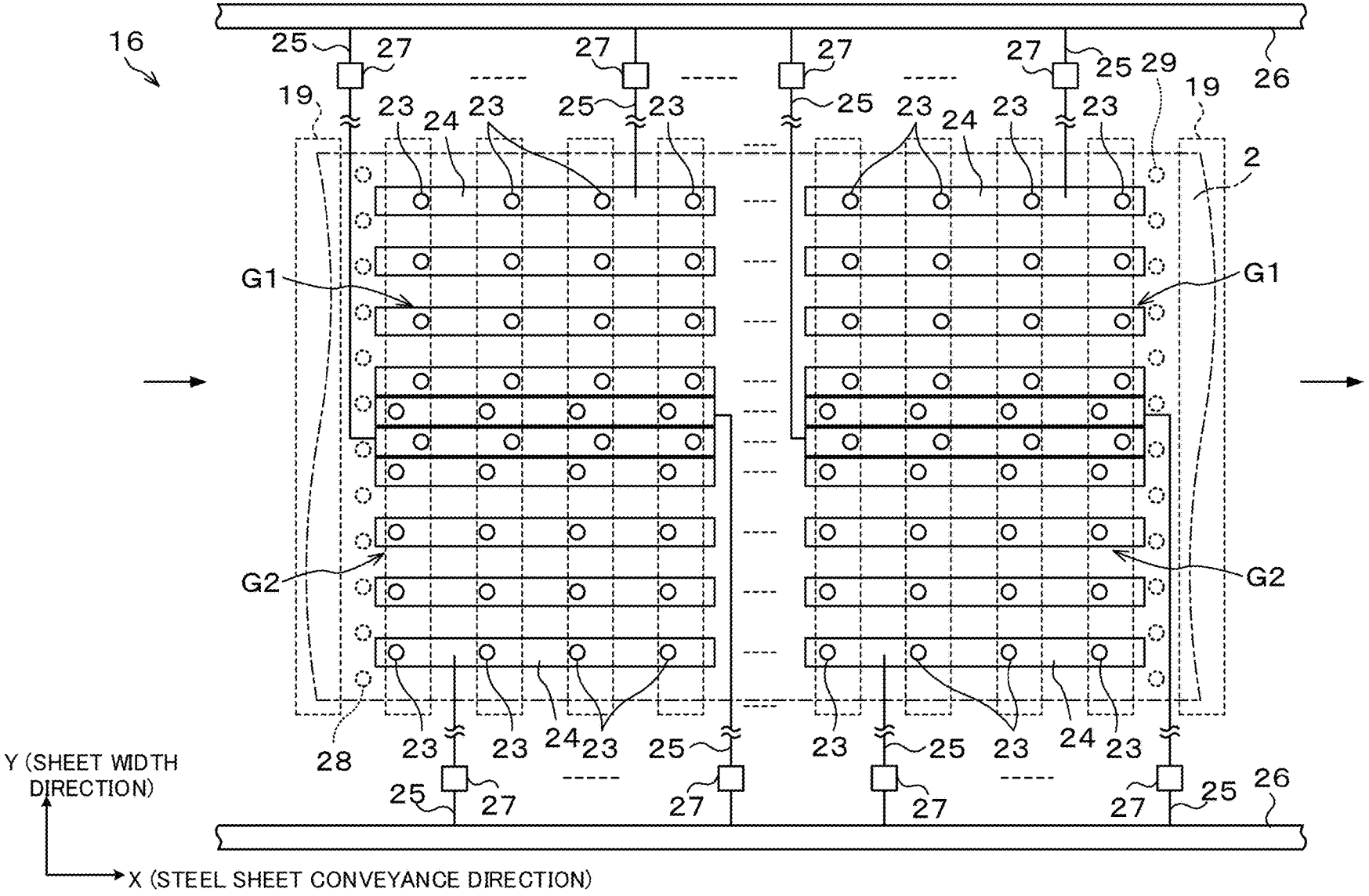
FIG. 3 is a bottom view illustrating the outline of the configuration of the upper width-direction control cooling device 16 according to the first embodiment of the present invention.

Next, the configuration of the upper cooling device 16 is explained. FIG. 2 illustrates a side view schematically illustrating a part of the configuration of the upper cooling device 16, which is viewed from the width direction (±Y direction), and FIG. 3 illustrates a bottom view schematically illustrating a part of the configuration of the upper cooling device 16, which is viewed from below in the vertical direction (±Z direction). Incidentally, in FIG. 2, out of cooling water nozzles 23, the cooling water nozzles 23 belonging to a first nozzle group G1 are illustrated by a virtual line. Further, in FIG. 3, for convenience in explaining the horizontal positional relationship, the hot-rolled steel sheet 2, the conveyor rolls 19, upstream-side temperature measuring devices 28, and downstream-side temperature measuring devices 29 are illustrated by dotted lines.

The upper cooling device 16 in this form is schematically configured to include the cooling water nozzles 23, switching devices each including an intermediate header 24, a pipe 25, and a three-way valve 27, a water feed header 26, a drain header (not illustrated), the temperature measuring devices 28, 29, and a control device 30, as schematically illustrated in FIG. 2 and FIG. 3. The three-way valve 27 is arranged for each of the intermediate headers 24, which is partly omitted in the drawing.

The upper cooling device 16 is a device that controls cooling for each of divided cooling surfaces A3 made by division of an entire cooling region A1 formed on a top surface of a later-described cooling width region on the run out table. FIG. 4 to FIG. 7 each are a plan view illustrating the cooling width region on the run out table at a place where the upper cooling device 16 is arranged, which is viewed from above in the vertical direction (±Z direction), and illustrate a positional relationship between the entire cooling region A1, width-divided cooling zones A2, and the divided cooling surfaces A3 and the conveyor rolls 19. Incidentally, in FIG. 4 and FIG. 5, for explanatory convenience, the conveyor rolls 19 are illustrated by dotted lines. Incidentally, an under surface of the cooling width region is also a plane in contact with the top of the run out table.

In this form, a region where the hot-rolled steel sheet 2, which can be manufactured in the hot rolling facility 10, can be present during the time when the hot-rolled steel sheet 2 is conveyed on the run out table is referred to as the "cooling width region." The "cooling width region" is, that is, originally a three-dimensional region that is marked off by the maximum sheet thickness×(maximum sheet width+maximum meander width) of the hot-rolled steel sheet that can be manufactured and extends in the steel sheet conveyance direction. Therefore, the "cooling width region" covers the region from the exit-side end of the finishing mill to the front of the coiling device on the run out table in the steel sheet conveyance direction. This "cooling width region" is the "cooling target region" in this form. Incidentally, practically, the portion relating to the maximum sheet thickness can be ignored, and thus, the cooling width region, namely, the cooling target region, may be regarded as a two-dimensional region, namely, a plane marked off by (the maximum sheet width+the maximum meander width) in the plane in contact with the top of the run out table.

Figure 4:
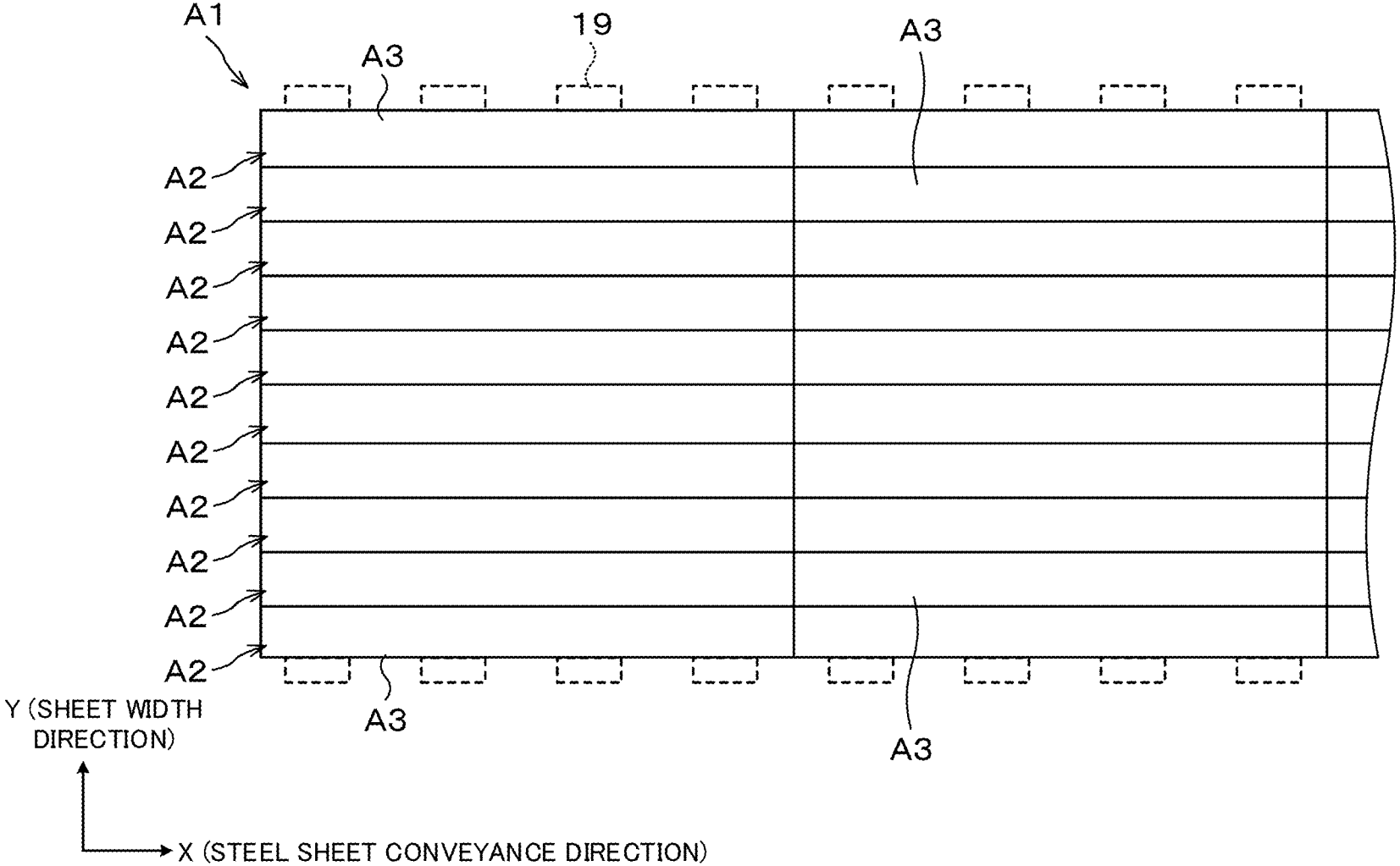
FIG. 4 is a view explaining divided cooling surfaces A3 of one example.

Out of the top surface of the cooling width region, the region demarcated by a full width in the machine width direction and a cooling machine length, which is the region to be cooled by the upper cooling device 16, is set to the "entire cooling region A1." FIG. 4 illustrates one example of the entire cooling region A1. Incidentally, the "machine width" is the length of the upper cooling device 16 in the machine width direction (hereinafter, the length in the machine width direction is sometimes referred to as the length in the width direction or the width in the width direction width, but they are the same in meaning), and the "full width in the width direction" is the length in the width direction of the region where the hot-rolled steel sheet 2 can be present on the conveyor rolls 19. The "cooling machine length" is the length of the region to be cooled by the upper cooling device 16 in the steel sheet conveyance direction, and is the length for at least one pitch or more (for example, 1 meter or more) between rolls of the conveyor rolls 19 in the steel sheet conveyance direction. The "one-pitch length between rolls in the steel sheet conveyance direction" means the distance between axes of the conveyor rolls 19 adjacent to each other in the steel sheet conveyance direction. The "cooling machine length" is not limited in particular, but is preferably about 20 m or less from the viewpoint of facility cost. The concrete length only needs to be determined from the cooling capacity of the upper cooling device 16 and a predicted aspect of the nonuniform temperature distribution of the hot-rolled steel sheet 2, as appropriate.

Figure 5:
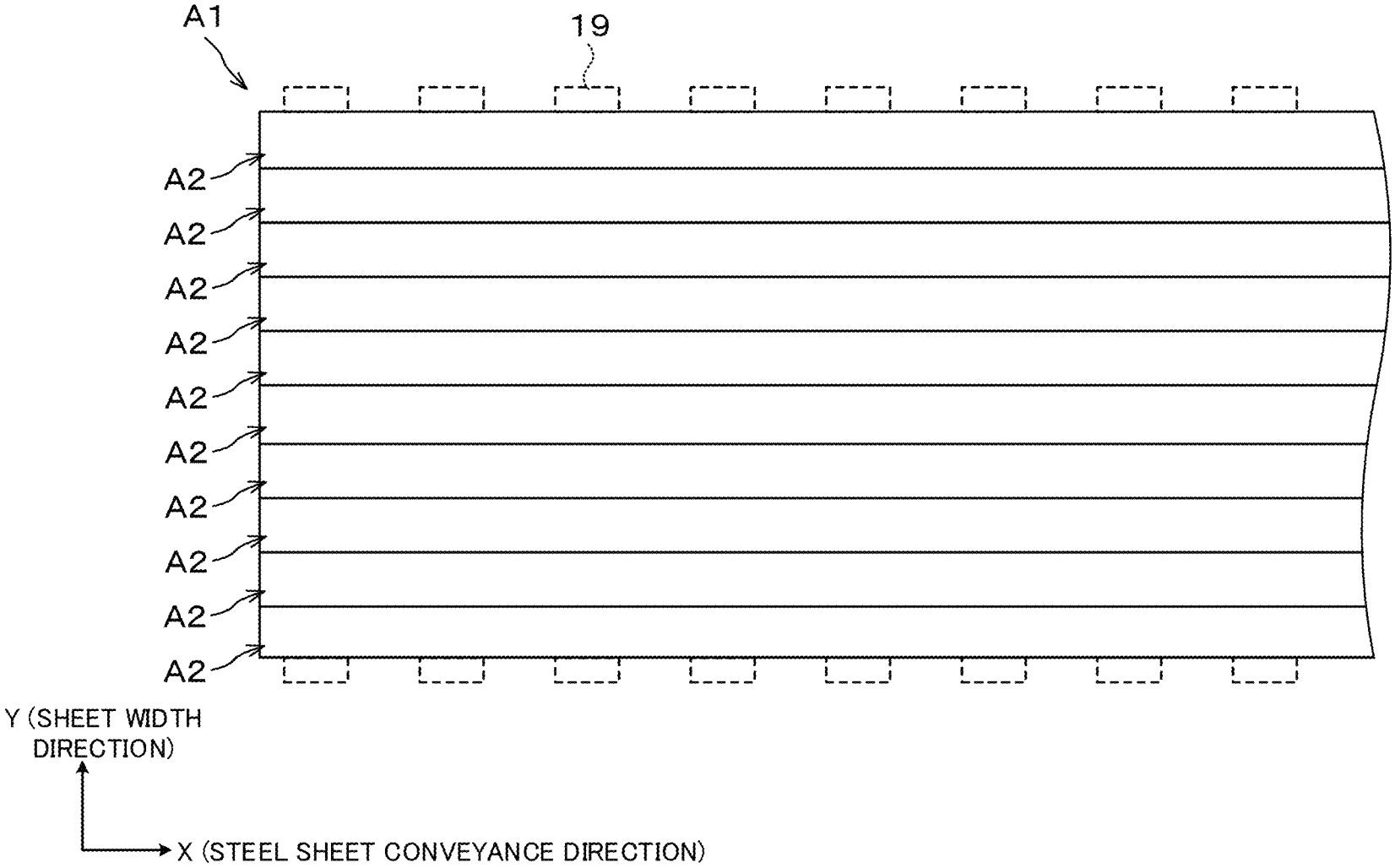
FIG. 5 is an explanatory view that focuses on width-divided cooling zones A2.
Figure 6:
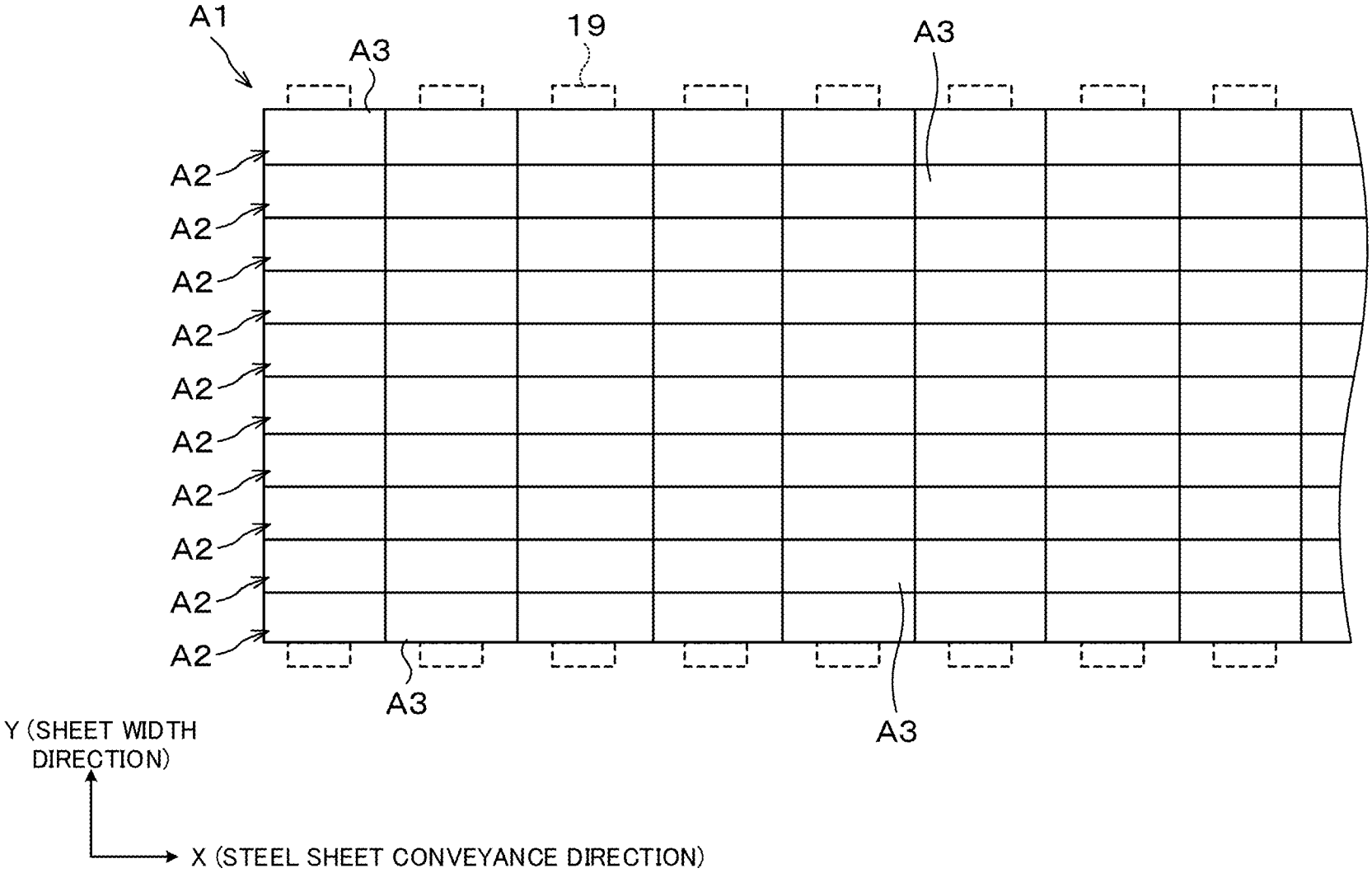
FIG. 6 is a view explaining the divided cooling surfaces A3 of another example.

Each of cooling regions obtained by dividing the entire cooling region A1 into three or more regions in the machine width direction, namely, the width direction, is set to the "width-divided cooling zone A2." FIG. 5 illustrates an example where the entire cooling region A1 is divided into ten width-divided cooling zones. The number of divisions of the entire cooling region A1 in the width direction (namely, the number of width-divided cooling zones A2 in the width direction) is not limited to this. For the uniformity of the width-direction temperature distribution, a larger number of divisions are better. For example, the lower limit of the number of divisions may be set to 4, 6, 8, 10, or 12. However, if the number of divisions is increased, the facility cost increases, so that the upper limit of the number of divisions may be set to 30, 20, 16, or 14.

Further, each of cooling regions obtained by dividing the width-divided cooling zone A2 into a plurality of regions in the machine length direction, namely, the steel sheet conveyance direction is set to the "divided cooling surface A3." The length of each of the divided cooling surfaces A3 in the width direction is the same as the length of the width-divided cooling zone A2 in the width direction. The length of the divided cooling surface A3 in the steel sheet conveyance direction is the length obtained by equally dividing the length of the width-divided cooling zone A2 in the steel sheet conveyance direction, for example, by the number of divisions.

The length of the divided cooling surface A3 in the steel sheet conveyance direction is not limited in particular, but can be set appropriately. The length of the divided cooling surface A3 in the steel sheet conveyance direction illustrated in FIG. 4 is set to be four times as long as one pitch of the conveyor rolls 19. Further, in the example in FIG. 6, the length of the divided cooling surface in the steel sheet conveyance direction is set to the length for one pitch of the conveyor rolls 19. As above, the length of the divided cooling surface A3 in the steel sheet conveyance direction is preferably an integral multiple of the pitch between rolls of the conveyor rolls 19 in the steel sheet conveyance direction.

Figure 7:
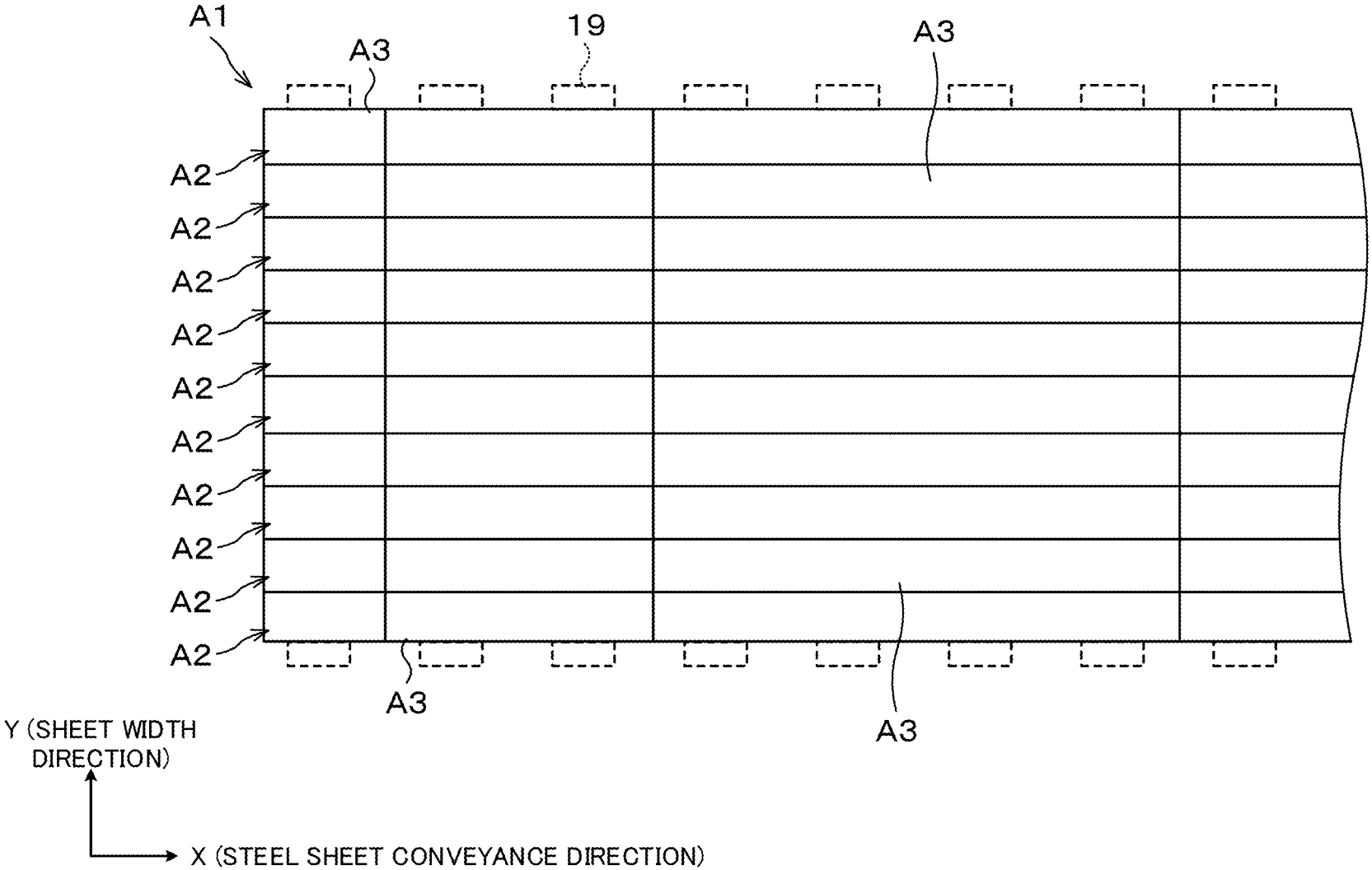
FIG. 7 is a view explaining the divided cooling surfaces A3 of another example.

Incidentally, the lengths of a plurality of the divided cooling surfaces A3 in the steel sheet conveyance direction, which are aligned adjacent to each other in the steel sheet conveyance direction, do not need to be the same and may differ from each other. In other words, the width-divided cooling zone A2 may be a combination of the divided cooling surfaces A3 having different lengths in the steel sheet conveyance direction. For example, as illustrated in FIG. 7, the length of the divided cooling surface A3 in the steel sheet conveyance direction may be increased sequentially from the upstream side to the downstream side by 1 pitch, 2 pitches, 4 pitches, 8 pitches, . . . between rolls of the conveyor rolls 19 in the steel sheet conveyance direction.

Incidentally, in the following explanation, as illustrated in FIG. 4, the length of the divided cooling surface A3 in the steel sheet conveyance direction is set to be equivalent to the length for 4 pitches between rolls of the conveyor rolls 19 in the steel sheet conveyance direction.

At least one cooling water nozzle 23 is provided for each of the above-described divided cooling surfaces A3. The cooling water nozzles 23 jet cooling water from above the cooling width region to the top surface of the cooling width region. Various well-known types of nozzles can be used for the cooling water nozzles 23, and examples thereof include a full cone spray nozzle to which a back pressure of about 0.3 MPa is applied (to be sometimes referred to as a "full cone nozzle" below). Further, the cooling water nozzles 23 are preferably small in diameter to prevent the cooling water from falling off from the cooling water nozzle 23 in a standby state.

Incidentally, the width of a cooling range of the cooling water nozzle 23 in the width direction is preferably set to a length including the length of the corresponding divided cooling surface A3 in the width direction and lengths of portions of the adjacent divided cooling surfaces A3 on both sides in the width direction. If the cooling range of the cooling water nozzle 23 in the width direction is limited to the width of the single divided cooling surface A3 in the width direction, there is a concern that the cooling capacity on a boundary line between the divided cooling surface A3 and another divided cooling surface A3 that are adjacent to each other in the width direction becomes insufficient. In order to solve this lack of cooling, the width in the width direction, where a later-described cooling water collision region R of the nozzle 23 overlaps another cooling water collision region R adjacent in the width direction, is preferably set to be 5% or more of the width of the cooling water collision region in the width direction. The width in the width direction, where the cooling water collision region R overlaps the another adjacent cooling water collision region R, is more preferably set to 7% or more or 8% or more of the width of the cooling water collision region in the width direction. The width in the width direction, where the cooling water collision region R overlaps the another adjacent cooling water collision region R, is more preferably set to 15% or less of the width of the cooling water collision region in the width direction. The width in the width direction, where the cooling water collision region R overlaps the another adjacent cooling water collision region R, is more preferably set to 13% or less or 11% or less of the width of the cooling water collision region in the width direction.

Figure 8:
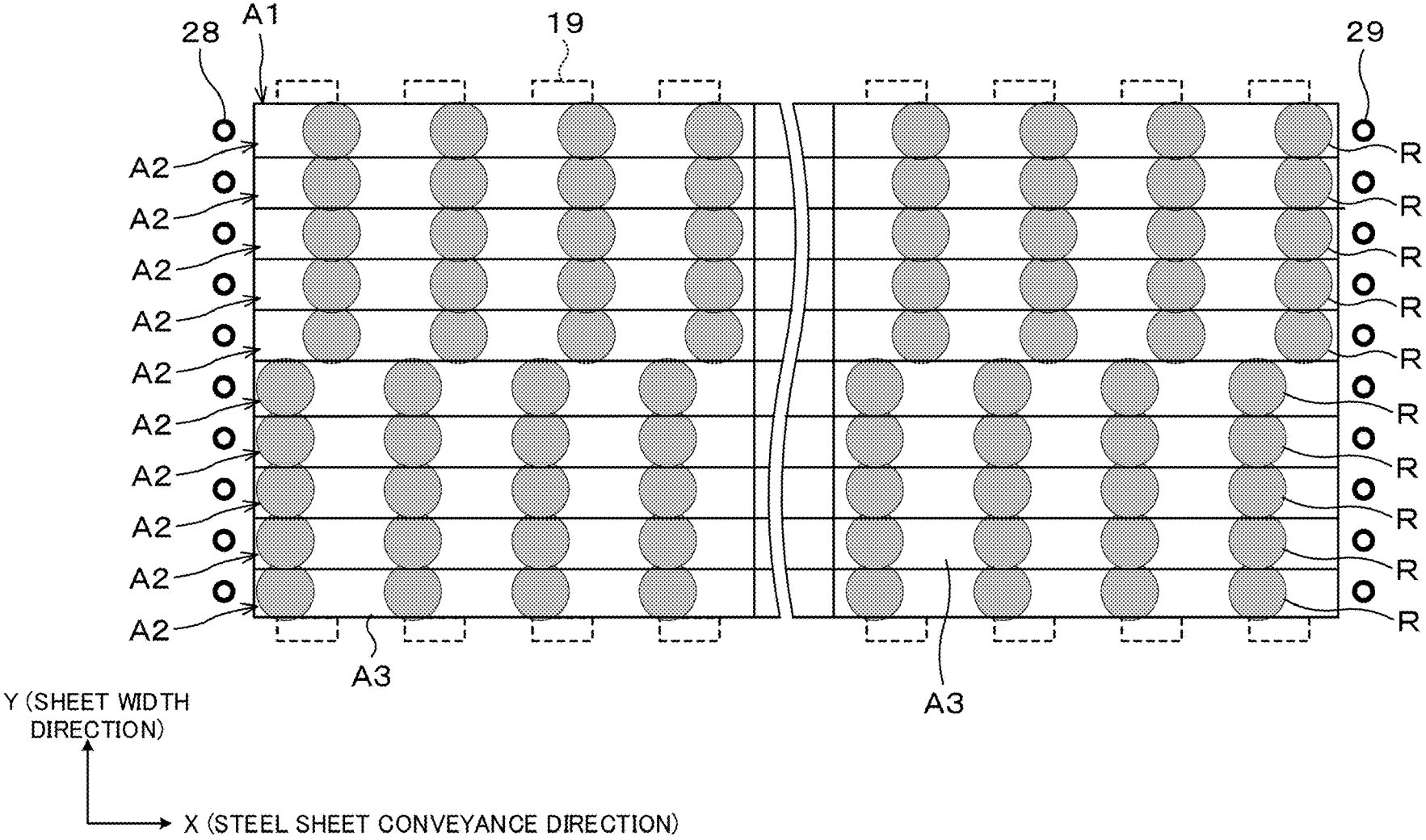
FIG. 8 is a view explaining a positional relationship of the divided cooling surfaces A3 and temperature measuring devices 28, 29 in the upper width-direction control cooling device 16 according to the first embodiment of the present invention.

FIG. 8 is a view illustrating, as a plan view, the width-divided cooling zones A2 obtained by division of the entire cooling region A1 on the top surface of the cooling width region in the upper cooling device 16 in the width direction and the divided cooling surfaces A3 obtained by division of the width-divided cooling zones A2 in the steel sheet conveyance direction, which are viewed from above in the vertical direction (±Z direction), as well as illustrating the regions (cooling water collision regions) R each formed by the cooling water from the cooling water nozzle 23 provided for each divided cooling surface A3 colliding with the top surface of the cooling width region corresponding to the divided cooling surface A3. The cooling water nozzles 23 are arranged so that at least one cooling water collision region R is formed on each of the divided cooling surfaces A3. The width of one cooling water collision region R is larger than the width of the divided cooling surface A3 to which the cooling water collision region R belongs.

In this form, the cooling water nozzles 23 are arranged so that four cooling water collision regions R are formed on one divided cooling surface A3. The four cooling water nozzles 23 and the four cooling water collision regions R are arranged in plan view for each of the conveyor rolls 19 and are aligned in the steel sheet conveyance direction. The number of cooling water nozzles 23 corresponding to one divided cooling surface A3 is not limited in particular, but may be one or more if the full width of each of the divided cooling surfaces A3 in the width direction is covered with the cooling water collision region R by the cooling water nozzle 23 provided for the divided cooling surface A3.

Incidentally, when the cooling water nozzles 23 in the width direction and the steel sheet conveyance direction are made the same in volume of water to be jetted from the cooling water nozzle 23 and flow rate and their cooling capacities are made the same, control is easier. Further, when a plurality of the cooling water nozzles 23 aligned in the width direction and installed for each of the divided cooling surfaces A3, which are located at the same position in the steel sheet conveyance direction, are made the same in type, number, jetting water volume, and jet flow rate and their cooling capacities on the divided cooling surfaces A3 aligned in the width direction are made the same, control is easier.

Further, the cooling water nozzles 23 that are the same in jetted water volume and jet flow rate, which belong to the divided cooling surfaces A3 aligned in the width direction, are preferably arranged so that the distances each between centers of the cooling water nozzles 23 adjacent in the width direction and/or the distances each between centers of the cooling water collision regions R formed by the cooling water nozzles 23 all become equal in distance. This makes it possible to perform uniform cooling in the width direction with higher accuracy.

Incidentally, even if the cooling water nozzles 23 differ in cooling capacity based on the jetting water volume and the jet flow rate in the width direction and the steel sheet conveyance direction, the control by the control device 30 is possible.

Figure 9:
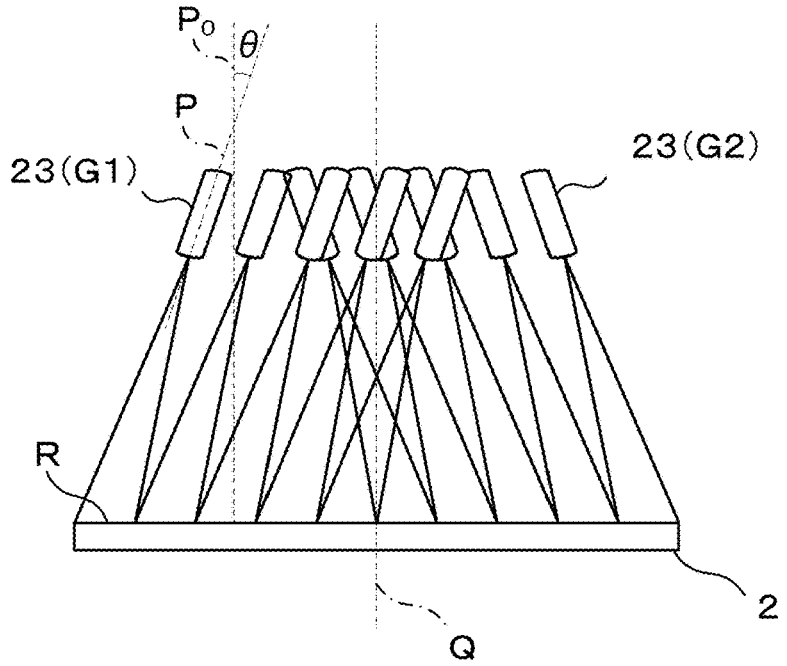
FIG. 9(A) and FIG. 9(B) are views explaining cooling water nozzles 23 and cooling water collision regions R formed thereby on a top surface of a cooling width region.
Figure 9:
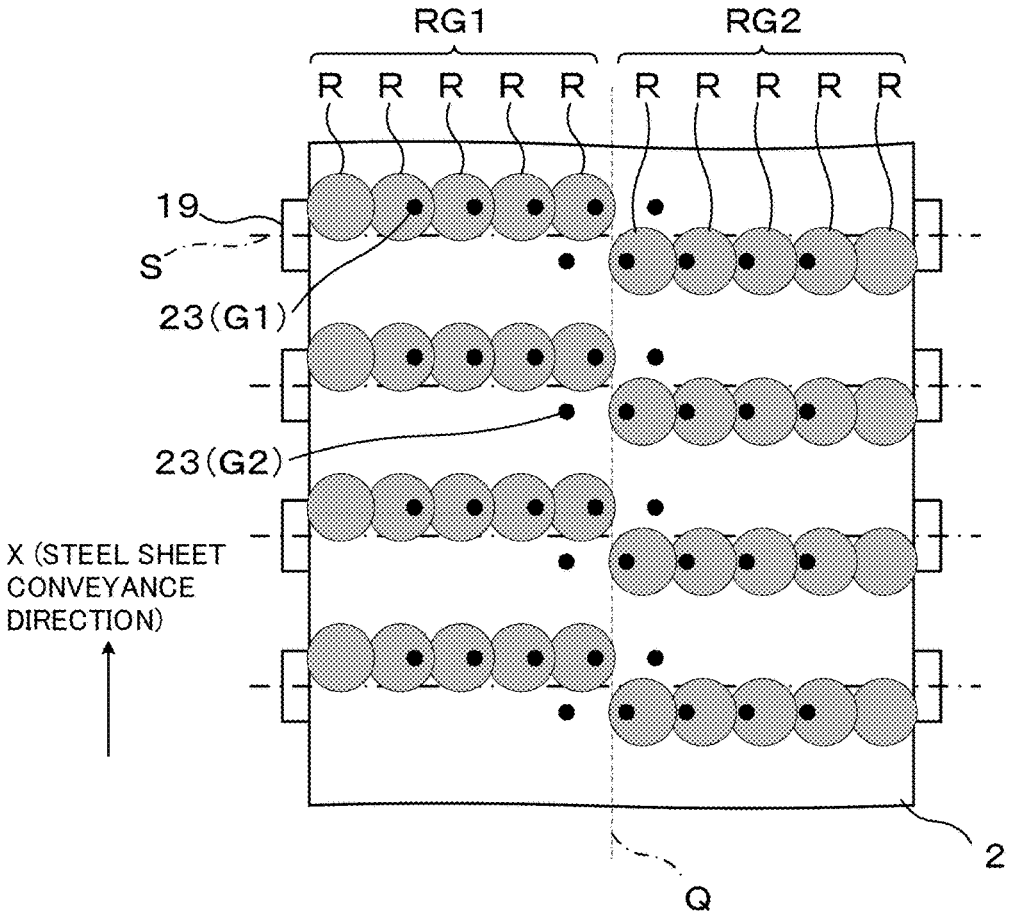

FIG. 9(A) and FIG. 9(B) are views explaining the cooling water nozzles 23. FIG. 9(A) is a front view illustrating the cooling water nozzles 23 viewed from the steel sheet conveyance direction, and FIG. 9(B) is a plan view illustrating regions (the cooling water collision regions) R where cooling waters from the cooling water nozzles 23 collide with the cooling width region, namely the top surface of the hot-rolled steel sheet 2 viewed from above in the vertical direction (±Z direction). Incidentally, in FIG. 9(B), the positions of jetting ports of cooling water of the cooling water nozzles 23 each are illustrated by a small "•."

As illustrated in FIG. 9(A), the cooling water nozzles 23 each have a jet axis P inclined with respect to a vertical line $P_0$ to the top surface of the hot-rolled steel sheet 2, when viewed in the steel sheet conveyance direction, and the cooling water jetted from the cooling water nozzle 23 collides with the cooling water collision region R, and then goes to the side opposite to the cooling water nozzle 23 in the width direction. In this form, the cooling water nozzles 23 form either a first nozzle group G1 or a second nozzle group G2. The cooling water nozzles 23 of the first nozzle group G1 each have the jet axis P inclined so as to jet cooling water to one side in the width direction, and thereby the cooling water is drained from one end side in the width direction. The cooling water nozzles 23 of the second nozzle group G2 each have the jet axis P inclined in a direction opposite to the cooling water nozzles 23 of the first nozzle group G1 so as to jet cooling water to the other side in the width direction, and thereby the cooling water is drained from the other end side in the width direction.

The cooling water collision regions R made by the cooling water nozzles 23 forming the first nozzle group G1 form a first cooling water collision region group RG1 (to be sometimes abbreviated to a first region group RG1, below), where the cooling water collision regions R are connected in the width direction while overlapping another cooling water collision region R adjacent in the width direction. Further, the cooling water collision regions R made by the cooling water nozzles 23 forming the second nozzle group G2 form a second cooling water collision region group RG2 (to be sometimes abbreviated to a second region group RG2, below), where the cooling water collision regions R are connected in the width direction while overlapping another cooling water collision region R adjacent in the width direction.

The cooling water nozzles 23 of the first nozzle group G1 forming the first region group RG1 and the cooling water nozzles 23 of the second nozzle group G2 forming the second region group RG2 are inclined so as to be symmetrical to each other when viewed in the steel sheet conveyance direction. Then, the cooling water nozzles 23 forming the first nozzle group G1 that forms the first region group RG1 have the jet axes P that are all inclined with respect to the above-described vertical line $P_0$ in the same direction when viewed in the machine length direction. That is, among the cooling water nozzles 23 forming the first nozzle group G1 that forms the first region group RG1, none of the cooling water nozzles have the jet axis P inclined with respect to the above-described vertical line $P_0$ in the opposite direction, and the cooling water nozzles 23 jet cooling water to one side in the width direction. Further, the cooling water nozzles 23 forming the second nozzle group G2 that forms the second region group RG2 also have the jet axes P that are all inclined with respect to the above-described vertical line $P_0$ in the same direction when viewed in the machine length direction. That is, among the cooling water nozzles 23 forming the second nozzle group G2 that forms the second region group RG2, none of the cooling water nozzles have the jet axis P inclined with respect to the above-described vertical line $P_0$ in the opposite direction, and the cooling water nozzles 23 jet cooling water to the other side in the width direction.

Each of the cooling water nozzles 23 is preferably provided so that the angle of its jet axis P with respect to the above-described vertical line $P_0$, namely an inclination angle θ, becomes greater than half of the angle of spreading of the cooling water jetted from the cooling water nozzle 23. The above-described inclination angle θ of the cooling water nozzle 23 is, for example, 10° to 45°. Incidentally, the angle of spreading of the cooling water jetted from the cooling water nozzle 23 is, for example, about 12°, and the cooling water collision region R is formed so as to have its diameter of 200 mm, for example.

Further, as can be seen from the positional relationship between the position of the jetting port of cooling water of the cooling water nozzle 23 illustrated by "•" in the drawing and the cooling water collision region R, the jet axis P of the cooling water nozzle 23 is not inclined in the steel sheet conveyance direction, concretely, it is not inclined downstream in the steel sheet conveyance direction and is substantially parallel to the width direction in plan view. Incidentally, it is not necessary to exclude that the jet axis P of the cooling water nozzle 23 is inclined in the steel sheet conveyance direction. Inclination of the jet axis P is not necessary, and no inclination of the jet axis P is preferred.

Further, the cooling water nozzles 23 of the first nozzle group G1 and the cooling water nozzles 23 of the second nozzle group G2 both are provided at the position of the single conveyor roll 19. Then, the respective cooling water nozzles 23 are provided so as to prevent each cooling water collision region group from overlapping another cooling water collision region group (namely, prevent the first region groups RG1 from overlapping with each other, prevent the second region groups RG2 from overlapping with each other, and prevent the first region group RG1 and the second region group RG2 from overlapping with each other). Further, the cooling water nozzles 23 are provided so that the first region group RG1 and the second region group RG2 adjacent to this first region group RG1 in the steel sheet conveyance direction cover the cooling width region, namely the full width of the hot-rolled steel sheet 2 in the width direction. As described previously, since the respective cooling water nozzles 23 are provided so as to prevent each cooling water collision region group from overlapping another cooling water collision region group, jets of cooling water from the first nozzle group G1 and jets of cooling water from the second nozzle group G2 do not interfere with each other even when the first region group RG1 and the second region group RG2 cover the cooling width region, namely, the full width of the hot-rolled steel sheet 2 in the width direction. Incidentally, as a method to prevent each cooling water collision region group from overlapping another cooling water collision region group, there is a method of shifting the positions of the cooling water nozzles 23 forming one cooling water collision region group from the positions of the cooling water nozzles 23 forming another cooling water collision region group in the steel sheet conveyance direction. Further, the positions of the cooling water nozzles 23 forming the first region group RG1 and the positions of the cooling water nozzles 23 forming the second region group RG2 are shifted back and forth in the steel sheet conveyance direction, thereby making it possible to prevent two cooling water collision region groups from overlapping with each other on the top surface of the cooling width region even in the case where the cooling water nozzles 23 forming the first region group RG1 and the cooling water nozzles 23 forming the second region group RG2 overlap when viewed in the steel sheet conveyance direction. As a result, it is possible to prevent the cooling waters from the cooling water nozzles 23 themselves from interfering with each other. Incidentally, as described above, the width of one cooling water collision region R is larger than the width of the divided cooling surface A3 to which the cooling water collision region R belongs. Therefore, one cooling water collision region R fails to belong to the same cooling water collision region group RG as another cooling water collision region R that belongs to the same width-divided cooling zone A2.

Further, as described above, since the cooling water nozzles 23 are provided so as to prevent each cooling water collision region group from overlapping another cooling water collision region group, drained water of the cooling waters that have been jetted from the cooling water nozzles 23 forming any cooling water collision region group to collide with the hot-rolled steel sheet 2 is not obstructed by the cooling waters that have been jetted from the cooling water nozzles 23 forming another cooling water collision region group to collide with the hot-rolled steel sheet 2.

Incidentally, in this form, the first region group RG1 and the second region group RG2 are arranged in a staggered pattern in plan view with respect to the position where the conveyor roll 19 is arranged. Concretely, for one conveyor roll 19, each one first region group RG1 and each one second region group RG2 are set, and the first region group RG1 and the second region group RG2 for one conveyor roll 19 are arranged alternately along the steel sheet conveyance direction. For example, the first region group RG1 is set so as to make the center of the cooling water collision region R located downstream of a center axis S of the conveyor roll 19 in the steel sheet conveyance direction, and the second region group RG2 is set so as to make the center of the cooling water collision region R located upstream of the center axis S of the conveyor roll 19 in the steel sheet conveyance direction.

The cooling water collision region R made by each of the cooling water nozzles 23 has a length in the width direction and a lap width (a length in the width direction of an overlapping region between the cooling water collision regions R adjacent to each other in the width direction) that are set so as to prevent occurrence of nonuniform cooling, such as insufficient cooling capacity, in an intermediate portion between the cooling water collision regions R adjacent in the width direction. Incidentally, in the example in FIG. 9(A) and FIG. 9(B), the first region group RG1 and the second region group RG2 overlap in a middle Q of the cooling width region in the width direction when viewed in the steel sheet conveyance direction, and the length of this overlapping region in the width direction is set in the same manner as the lap width described above.

Further, in the example in FIG. 9(A) and FIG. 9(B), the boundary between the first region group RG1 and the second region group RG2 coincides with the middle Q of the cooling width region in the width direction. By the way, the number of cooling water nozzles 23 forming each nozzle group sometimes differs between the first nozzle group G1 and the second nozzle group G2, and in this case, the boundary between the first region group RG1 by the first nozzle group G1 and the second region group RG2 by the second nozzle group G2 does not coincide with the middle Q of the cooling width region in the width direction. However, as the above-described boundary is closer to the middle Q in the width direction, the drainage from one end side in the width direction and the drainage from the other end side in the width direction are smoother respectively, and thus, the above-described boundary is preferably set to coincide with the middle Q in the width direction, as in the example in FIG. 9(A) and FIG. 9(B).

Further, in order to ensure sheet passing ability, the cooling water nozzles 23 are preferably provided so that the cooling water collision regions R overlap the center axis S of the conveyor roll 19 in plan view. From the viewpoint of ensuring the sheet passing ability, within a range where the jets of cooling water from the first nozzle group G1 and the jets of cooling water from the second nozzle group G2 do not interfere with each other, the centers of the cooling water collision regions R are preferably set at positions close to directly above the center axis S of the conveyor roll 19 in plan view.

We will return to the explanation of the upper cooling device 16.

The intermediate header 24 is a header that functions as a part of the switching device in this form and supplies cooling water to the cooling water nozzles 23. As can be seen from FIG. 2 and FIG. 3, in this form, the intermediate header 24 is a tubular member extending in the steel sheet conveyance direction, with a plurality of the cooling water nozzles 23 provided along the steel sheet conveyance direction. Thus, it is possible to control jetting and stopping of cooling water from the cooling water nozzles 23 arranged on the single intermediate header 24 simultaneously. In the illustrated example, four cooling water nozzles 23 are aligned in the steel sheet conveyance direction for one intermediate header 24, but the number of cooling water nozzles 23 is not limited to this.

Then, the intermediate headers 24 are arranged so that each one intermediate header 24 corresponds to one divided cooling surface A3. This makes it possible to switch control the jetting and the stopping of cooling water for each divided cooling surface A3.

The three-way valve 27 is a member that functions as a part of the switching device in this form. That is, the three-way valve 27 is a main member of the switching device that switches between collision and non-collision of the cooling water jetted from the cooling water nozzles 23 with the top surface of the cooling width region. The switching device is provided for each of the above-described divided cooling surfaces A3.

The three-way valve 27 in this form is of a diverting type and is a valve that switches whether to lead pressurized water from the water feed header 26 to the pipe 25 and feed it to the intermediate header 24 and then to the cooling water nozzles 23, or to lead the pressurized water to the drain header (not-illustrated). Incidentally, in this form, the drain header is illustrated as an example of a part for drainage, but this form is not limited in particular.

In place of the three-way valve 27 in this form, it is also possible to install two stop valves (valves for stopping the flow of fluid in a broad sense, to be sometimes called ON/OFF valves) to perform control in the same manner as the three-way valve. Using the three-way valve 27 makes it possible to reduce water-pressure fluctuations at a switching time.

In this form, one three-way valve 27 is provided for each of the intermediate headers 24 and is arranged between the water feed header 26 supplying cooling water and the drain header draining the cooling water.

The upstream-side temperature measuring device (to be referred to as the "first measuring device" below) 28 functions as a temperature detecting device in this form.

The first measuring devices 28 are arranged at positions on the under surface side of the cooling width region and measure the temperature of the hot-rolled steel sheet 2 on the upstream side of the entire cooling region A1 in the steel sheet conveyance direction as illustrated in FIG. 8.

The first measuring devices 28 are provided in a row in the width direction, corresponding to the width-divided cooling zones A2 respectively, so as to be able to measure the temperature on the upstream side of the width-divided cooling zones A2. This makes it possible to measure the temperature of the hot-rolled steel sheet 2 in the width direction on the upstream side of the upper cooling device 16 over the full width, that is, measure the width-direction temperature distribution of the hot-rolled steel sheet 2 on the upstream side of the upper cooling device 16.

The downstream-side temperature measuring device (to be referred to as the "second measuring device" below) 29 also functions as a temperature detecting device in this form.

The second measuring devices 29 are arranged at positions on the under surface side of the cooling width region and measure the temperature of the hot-rolled steel sheet 2 on the downstream side of the entire cooling region A1 in the steel sheet conveyance direction.

The second measuring devices 29 are provided in a row in the width direction, corresponding to the width-divided cooling zones A2 respectively, so as to be able to measure the temperature of the width-divided cooling zones A2 after cooling. This makes it possible to measure the temperature of the hot-rolled steel sheet 2 in the width direction on the downstream side of the upper cooling device 16 over the full width, that is, acquire the width-direction temperature distribution of the hot-rolled steel sheet 2 on the downstream side of the upper cooling device 16.

The configurations of the first measuring device 28 and the second measuring device 29 are not limited in particular as long as they measure the temperature of the hot-rolled steel sheet 2, but for example, the thermometer described in Japanese Patent No. 3818501 or the like is preferably used.

The control device 30 is a device that controls the operations of the switching devices based on either or both of measurement results of the first measuring devices 28 and measurement results of the second measuring devices 29. Concretely, the control device 30 controls, for each width-divided cooling zone A2, the operation of the switching device corresponding to each of a plurality of the divided cooling surfaces A3 contained in the width-divided cooling zone A2 based on either or both of measurement results of the first measuring device 28 and measurement results of the second measuring device 29, to thereby control the cooling for the entire length of the width-divided cooling zone A2 and control the cooling of the entire cooling region A1 with these controls together. The control device 30 includes an electronic circuit or a computer that performs an arithmetic operation based on a predetermined program, to which the first measuring devices 28, the second measuring devices 29, and the switching devices are electrically connected.

For example, the first measuring devices 28 measure the temperature of the hot-rolled steel sheet 2 to be conveyed on the run out table having the conveyor rolls 19 after having been rolled and then cooled by the main cooling device 15. The measurement results are sent to the control device 30, and the amount of cooling required to equalize the temperatures of the hot-rolled steel sheet 2 is calculated for each of the divided cooling surfaces A3.

Then, based on the calculation results, the control device 30 feedforward controls opening and closing of the three-way valve 27. That is, the control device 30 controls opening and closing of the three-way valve 27 to control collision and non-collision of the cooling water jetted from the cooling water nozzles 23 with the top surface of the hot-rolled steel sheet 2 for each of the divided cooling surfaces A3, in order to achieve uniformity of the temperatures of the hot-rolled steel sheet 2 in the width direction.

According to this form, the following effects are obtained.

In this form, as described above, based on the measurement results by the first measuring devices 28 that measure, over the full width, the temperature of the hot-rolled steel sheet 2 in the width direction that has been cooled by the main cooling device 15, collision and non-collision of the cooling water jetted from the cooling water nozzles 23 with the top surface of the hot-rolled steel sheet 2 are controlled for each of the divided cooling surfaces A3. Then, three or more divided cooling surfaces A3 are arranged in the width direction and a plurality of divided cooling surfaces A3 are arranged in the rolling direction, thus making it possible to uniformize the temperatures of the hot-rolled steel sheet 2 in the width direction and the rolling direction with high accuracy.

Further, according to this form, the jet axes P of the cooling water nozzles 23 are inclined with respect to the vertical line $P_0$ to the top surface of the cooling width region, and the cooling waters, which have been jetted from the cooling water nozzles 23 to collide with the cooling water collision regions R, go to the side opposite to the cooling water nozzles 23 in the width direction to be drained from one end or the other end of the hot-rolled steel sheet 2 in the width direction. Therefore, the cooling waters, which have been jetted from the cooling water nozzles 23 to collide with the cooling water collision regions R, no longer affect the cooling of the hot-rolled steel sheet 2 as water on the sheet.

It is set here that in the case where the main cooling device 15 and the adjustment cooling device 17 are already installed, cooling is performed based on the temperature in the middle portion of the hot-rolled steel sheet 2 in the width direction, and cooling is performed so as to bring the coiling temperature of the middle portion in the width direction to a target value, the upper cooling device 16 is arranged between the main cooling device 15 and the adjustment cooling device 17. Even in this case, according to this embodiment, it is possible to perform cooling so as to bring the coiling temperature of the middle portion of the hot-rolled steel sheet 2 in the width direction to a target value without changing the main cooling device 15 and the adjustment cooling device 17.

Incidentally, as in this form, in the case where further cooling of the hot-rolled steel sheet 2 having been cooled by the main cooling device 15 is performed based on the measurement results of the temperatures of the hot-rolled steel sheet 2 over the full width, unlike this embodiment, it is considered that the cooling water nozzles are provided vertically below (that is, at the under surface of) the cooling width region to spray cooling water from the under surface side of the cooling width region. However, in this case, maintenance can be difficult due to the presence of the conveyor rolls 19, and so on around the cooling water nozzles. In contrast to this, in this form, the cooling water nozzles 23 are provided above the cooling width region, which is high in maintainability. Incidentally, in the case where only the lower part of the main cooling device 15 is configured to extend downstream to provide cooling water nozzles also at the position facing the upper cooling device 16, there is no need to control these cooling water nozzles independently of the main cooling device 15. Therefore, the configuration becomes simple, and thus the maintainability is not questioned.

Further, in this form, the inclination angle θ of the jet axis P of the cooling water nozzle 23 is 10° to 45°.

Figure 10:
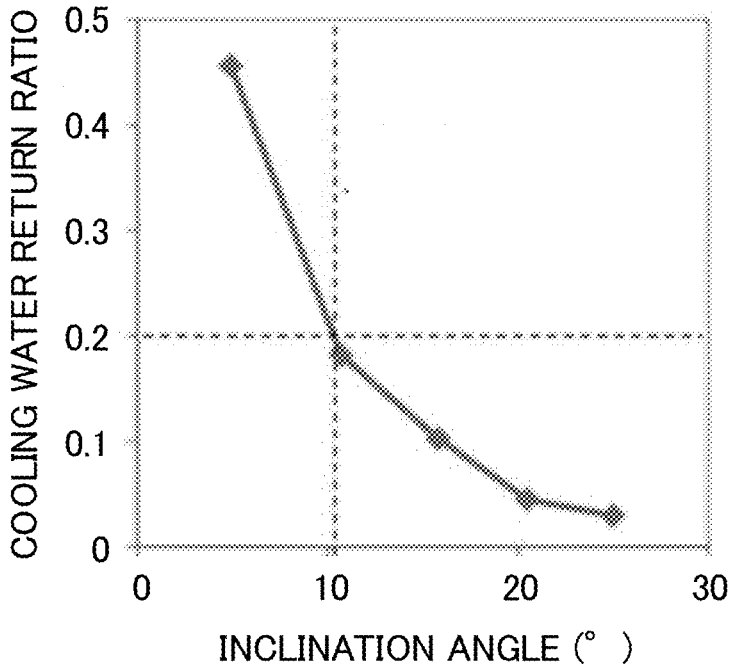
FIG. 10 is a view illustrating a relationship between an inclination angle θ of a jet axis P of the cooling water nozzle 23, which is a full cone spray nozzle, and a ratio of cooling water to return in the direction opposite to a cooling water jetting direction after colliding with a hot-rolled steel sheet 2 to cooling water from the cooling water nozzles 23.

FIG. 10 is a view illustrating a relationship between the inclination angle θ of the jet axis P of the cooling water nozzle 23, which is a full cone nozzle, and a ratio of cooling water to return in the direction opposite to a cooling water jetting direction after colliding with the hot-rolled steel sheet 2 to the cooling water from the cooling water nozzles 23 (to be referred to as a "return ratio of cooling water from the cooling water nozzles 23").

As illustrated in the drawing, the inclination angle θ of the jet axis P of the cooling water nozzle 23 is set to 10° or more, thereby making it possible to suppress the return ratio of cooling water from the cooling water nozzles 23 to two or less out of ten and reduce the amount of water on the sheet.

Figure 11:
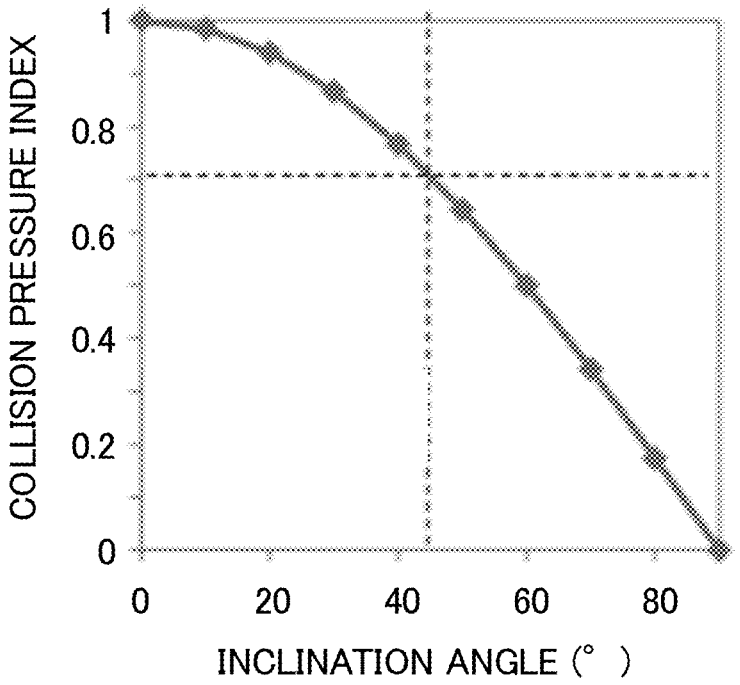
FIG. 11 is a view illustrating a relationship between the inclination angle θ of the jet axis P of the cooling water nozzle 23, which is a full cone spray nozzle, and a collision pressure index.

FIG. 11 is a view illustrating a relationship between the inclination angle θ of the jet axis P of the cooling water nozzle 23, which is a full cone nozzle, and a collision pressure index. The collision pressure index is an index relating to the pressure at which the cooling water jetted from the cooling water nozzle 23 collides with the hot-rolled steel sheet 2, and is an index to be one when the above-described inclination angle θ is 0°. As the collision pressure index is higher, the cooling capacity is high, which is desirable, but when the above-described inclination angle θ is 45° or less, the collision pressure index can be 0.7 or more.

Further, according to this form, the jet axes P of the cooling water nozzles 23 are not inclined in the steel sheet conveyance direction and are substantially parallel to the width direction in plan view. Unlike this form, if the jet axes P of the cooling water nozzles 23 are inclined in the steel sheet conveyance direction and are non-parallel to the width direction in plan view, the previously-described return ratio of cooling water from the cooling water nozzles 23 increases. Accordingly, when the jet axes P of the cooling water nozzles 23 are substantially parallel to the width direction in plan view as in this form, the above-described return ratio can be suppressed and high cooling capacity can be obtained. Further, in the case where the jet axes P of the cooling water nozzles 23 are not parallel to the width direction in plan view, the return ratio of cooling water increases and the collision pressure index decreases with respect to the inclination angle θ of the same jet axes, but in the case where the above-described jet axes P are parallel to the width direction in plan view and the angle with respect to the width direction is 0°, such a problem does not occur. Incidentally, the angle of the jet axis P of the cooling water nozzle 23 with respect to the sheet width direction in plan view is not limited to 0°. The above-described angle only needs to be equal to or less than an angle at which the previously-described return ratio of cooling water from the cooling water nozzles 23 is two or less out of ten and an angle at which the collision pressure index is 0.7 or more.

Furthermore, according to this form, the cooling water collision regions R of the cooling water nozzles 23 overlap the center axis S of the conveyor roll 19 in plan view. Therefore, the cooling water from the cooling water nozzles 23 does not impair the sheet passing ability of the hot-rolled steel sheet 2.

The intermediate header 24 is provided with the three-way valve 27, and when the number of cooling water nozzles 23 on the intermediate header 24 is smaller, controllability of the cooling water to be jetted to the hot-rolled steel sheet 2 improves. In the meantime, when the number of cooling water nozzles 23 is reduced, the number of required three-way valves 27 increases, resulting in an increase in facility and running costs. Accordingly, it is possible to set the number of cooling water nozzles 23 considering these balances.

In the case where a small volume of cooling water is used in order to make the cooling water collide with the divided cooling surface A3, the length of the entire cooling region A1 in the steel sheet conveyance direction is lengthened. For this reason, cooling water with a large water volume density of, for example, 1.0 $m^3/m^2/min$ or more is preferably jetted from the cooling water nozzle 23.

In the above-described explanation, the first measuring devices 28 and the second measuring devices 29 are arranged at the positions on the under surface side of the cooling width region, but may be arranged on the top surface side of the cooling width region and configured to measure the temperature of the hot-rolled steel sheet 2 from the top surface side. However, in the case of the configuration in which they measure the temperature of the hot-rolled steel sheet 2 from the top surface side of the cooling width region, it is necessary to provide a draining device on the upstream side of the temperature measuring devices, and the length of a region required for the temperature measurement in the steel sheet conveyance direction is increased by at least the size of this draining device, resulting in that a cooling speed, namely, the cooling capacity per unit length of the upper cooling device in the steel sheet conveyance direction decreases. Thus, like the first measuring devices 28 and the second measuring devices 29 described above, the configuration to measure the temperature of the hot-rolled steel sheet 2 from the under surface side of the cooling width region is preferable because there is no need to provide the draining device for the temperature measurement and the cooling capacity is high.

Further, in the above-described explanation, the opening and closing of the three-way valve 27 is feedforward controlled based on the measurement results of the first measuring devices 28, but may also be feedback controlled based on the measurement results of the second measuring devices 29. That is, the control device 30 may perform calculation by using the measurement results of the second measuring devices 29, and based on the calculation results, the number of openings and closings of the three-way valve 27 may be controlled for each of the divided cooling surfaces A3 that are different in position in the steel sheet conveyance direction. This makes it possible to control the collision and the non-collision of cooling water with the top surface of the cooling width region for each of the divided cooling surfaces A3.

In the upper cooling device 16, the feedforward control of the three-way valve 27 based on the measurement results of the first measuring devices 28 and the feedback control of the three-way valve 27 based on the measurement results of the second measuring devices 29 can be performed selectively.

Further, such feedback control can also be applied as a correction control of feedforward control results. As above, in the upper cooling device 16, the feedforward control of the three-way valve 27 based on the measurement results of the first measuring devices 28 and the feedback control of the three-way valve 27 based on the measurement results of the second measuring devices 29 can be performed in an integrated manner.

Incidentally, in the case where only one of the feedforward control and the feedback control is performed, either the first measuring devices 28 or the second measuring devices 29 may be omitted.

Another Example 1 of the Cooling Water Nozzles 23

Figure 12:
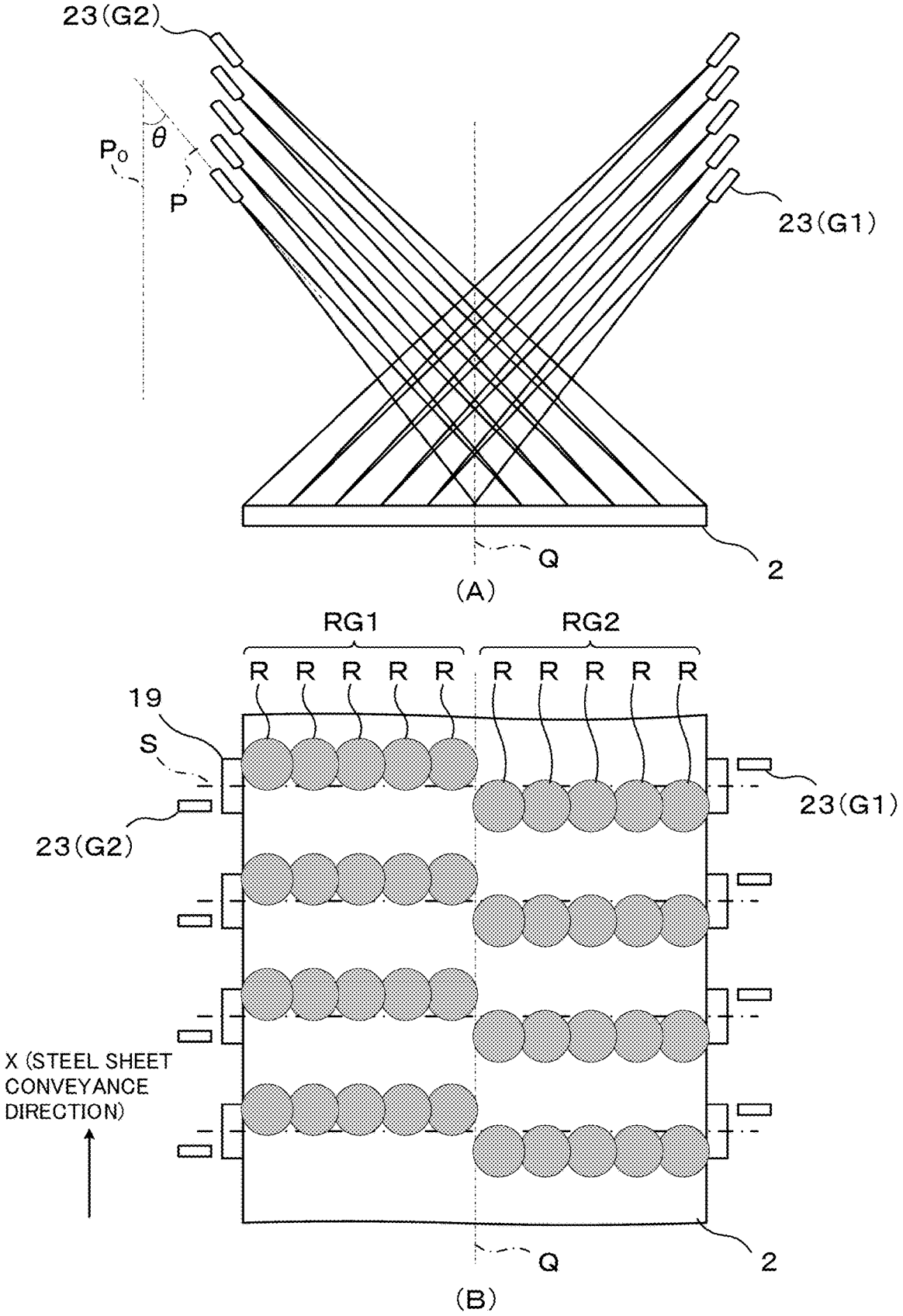
FIG. 12(A) and FIG. 12(B) are views explaining another example of the cooling water nozzles 23 and the cooling water collision regions R formed thereby on the top surface of the cooling width region.

FIG. 12(A) and FIG. 12(B) are views explaining another example of the cooling water nozzles 23.

It may be impossible to arrange the cooling water nozzles 23 directly above the hot-rolled steel sheet 2 (namely, directly above the cooling width region) as illustrated in FIG. 9(A) due to a reason such that another cooling device is already provided. In this case, as illustrated in FIG. 12(A), the cooling water nozzles 23 may be provided as side sprays on the outside of the hot-rolled steel sheet 2 (namely, on the outside of the cooling width region) when viewed in the steel sheet conveyance direction.

In this case as well, as in the previously-described example, as illustrated in FIG. 12(B), the first region group RG1 and the second region group RG2 are arranged in a staggered pattern in plan view with respect to the position where the conveyor roll 19 is arranged. Thus, there is no interference between the jets of cooling water from the first nozzle group G1 and the jets of cooling water from the second nozzle group G2 until the cooling waters collide with the hot-rolled steel sheet 2. Further, as described above, drained water of the cooling waters that have been jetted from the cooling water nozzles 23 to collide with the hot-rolled steel sheet 2 is not obstructed by the cooling waters that have been jetted from other cooling water nozzles 23 to collide with the hot-rolled steel sheet 2.

Incidentally, in this example case, the distance from the cooling water nozzle 23 to the top surface of the cooling width region differs for each nozzle. Therefore, the jet angles and the jetting pressures of cooling water from the respective cooling water nozzles 23 are preferably set so as to make the sizes of the cooling water collision regions R and the flow rates of cooling waters that collide with the cooling water collision regions R equal.

Another Example 2 of the Cooling Water Nozzles 23

Figure 13:
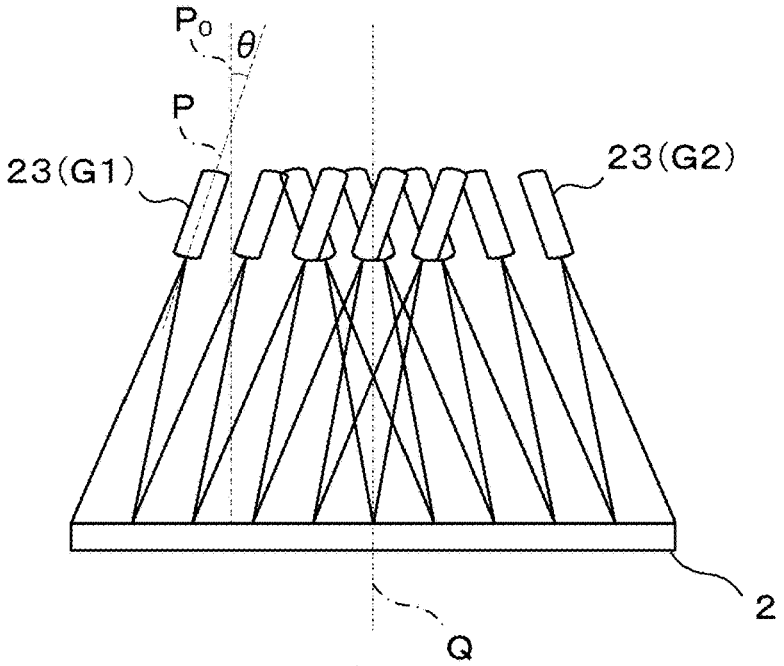
FIG. 13(A) and FIG. 13(B) are views explaining another example of the cooling water nozzles 23 and the cooling water collision regions R formed thereby on the top surface of the cooling width region.
Figure 13:
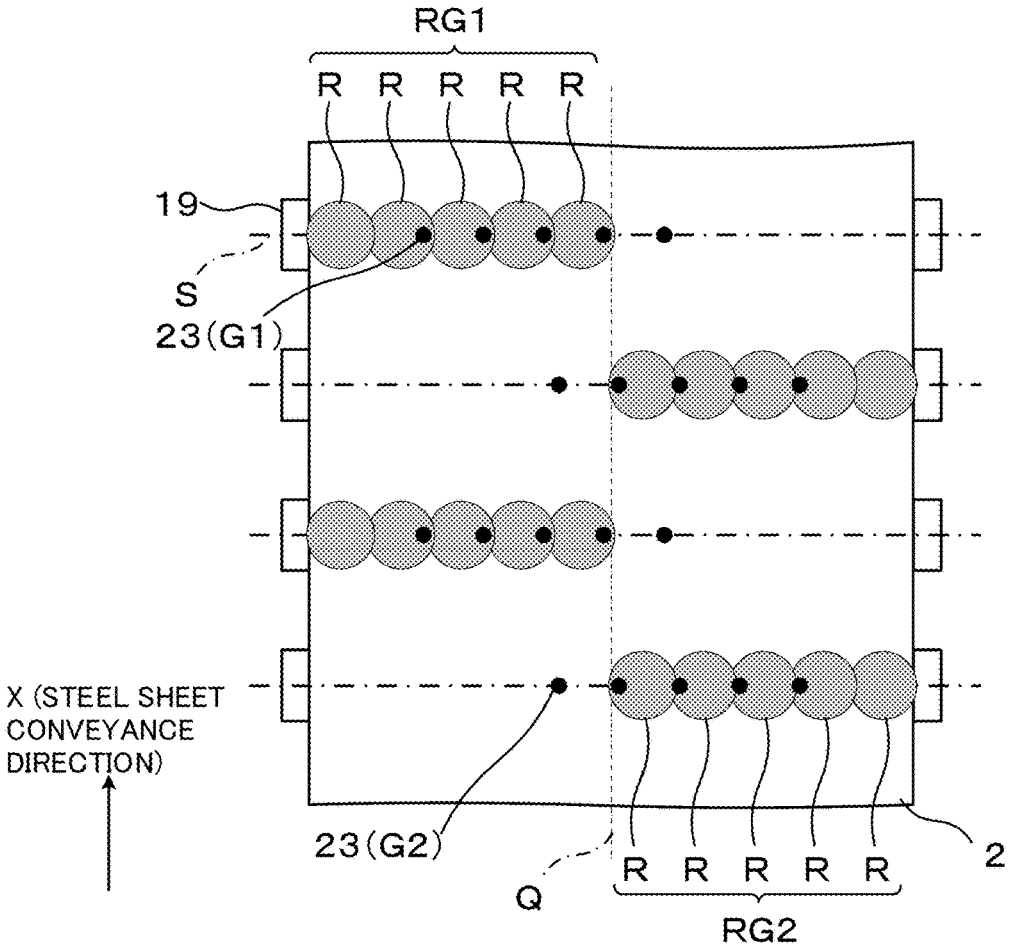

FIG. 13(A) and FIG. 13(B) are views explaining another example of the cooling water nozzles 23.

As illustrated in FIG. 13(A), the cooling water nozzles 23 in this example are arranged directly above the hot-rolled steel sheet 2 similarly to the example in FIG. 9(A) and FIG. 9(B).

Further, regarding the cooling water nozzles 23 in this example as well, as illustrated in FIG. 13(B), the first region group RG1 and the second region group RG2 are arranged in a staggered pattern in plan view with respect to the position where the conveyor roll 19 is arranged. However, in this example, unlike the previous example, each one of the first region group RG1 and the second region group RG2 is set for one conveyor roll 19, and the first region group RG1 and the second region group RG2 are arranged alternately along the steel sheet conveyance direction. Then, the first region group RG1 and the second region group RG2 are set so as to make, in plan view, the centers of the cooling water collision regions R located on the center axis S of the conveyor roll 19.

The cooling water nozzles 23 in this example are arranged so as to make, in plan view, the centers of the cooling water collision regions R located on the center axis S of the conveyor roll 19. Therefore, the sheet passing ability of the hot-rolled steel sheet 2 can be maintained higher.

Incidentally, in the case where the cooling water collision regions R are provided as in this example, similarly to FIG. 12(A), the cooling water nozzles 23 may be provided as side sprays on the outside of the hot-rolled steel sheet 2 (namely, on the outside of the cooling width region) when viewed in the steel sheet conveyance direction.

Another Example 3 of the Cooling Water Nozzles 23

Figure 14:
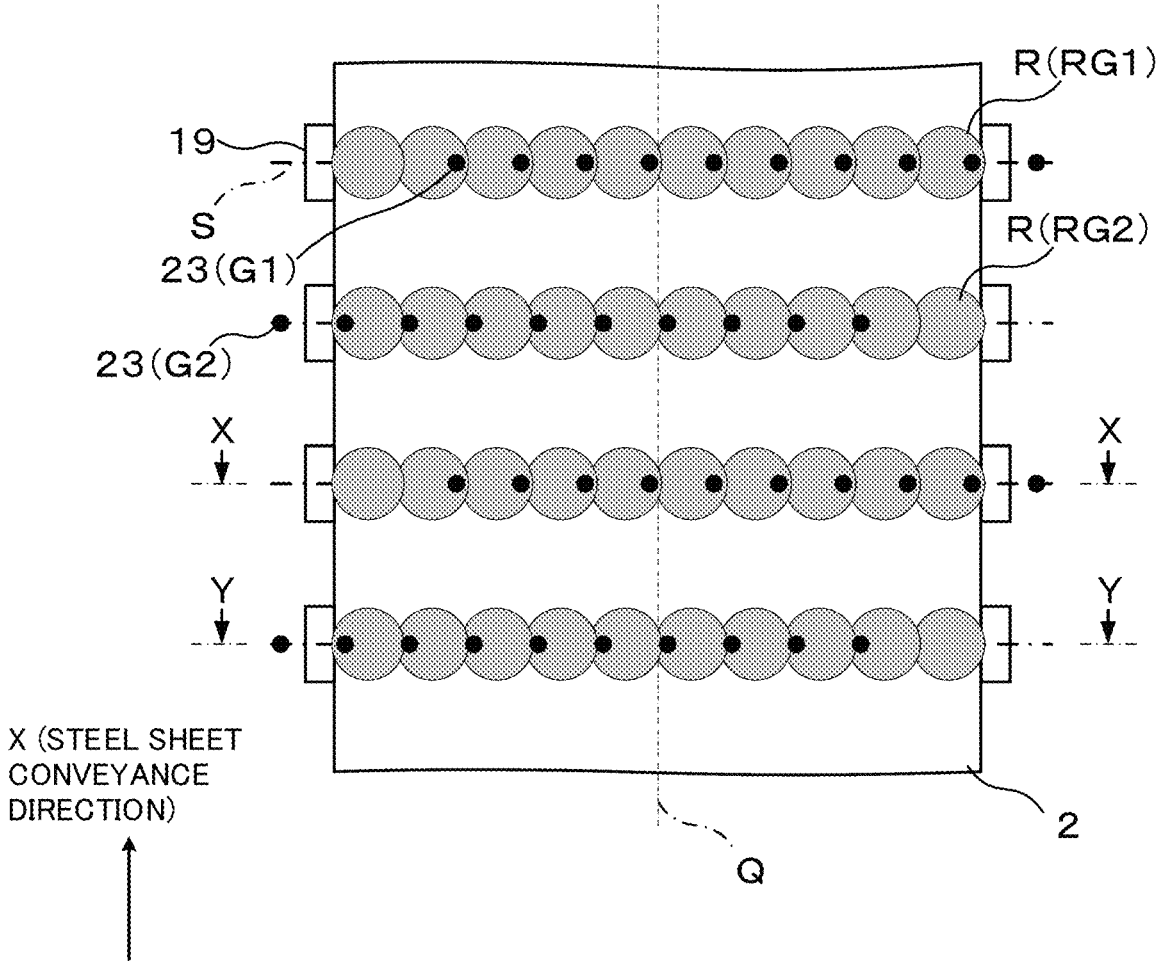
FIG. 14 is a view explaining another example of the cooling water nozzles 23 and the cooling water collision regions R formed thereby on the top surface of the cooling width region.
Figure 15:
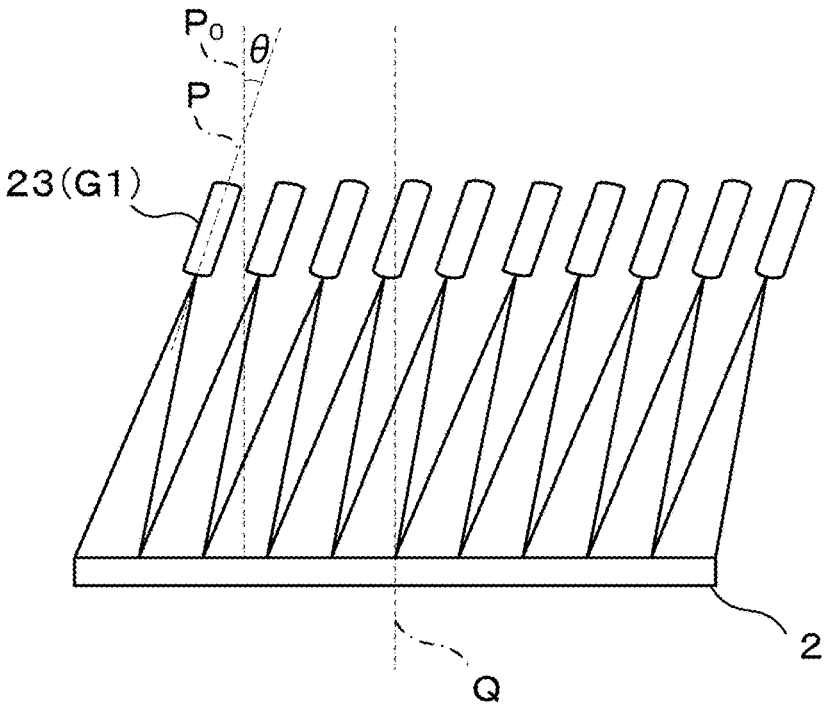
FIG. 15(A) and FIG. 15(B) are views illustrating a part of an X-X cross section and a part of a Y-Y cross section in FIG. 14.
Figure 15:
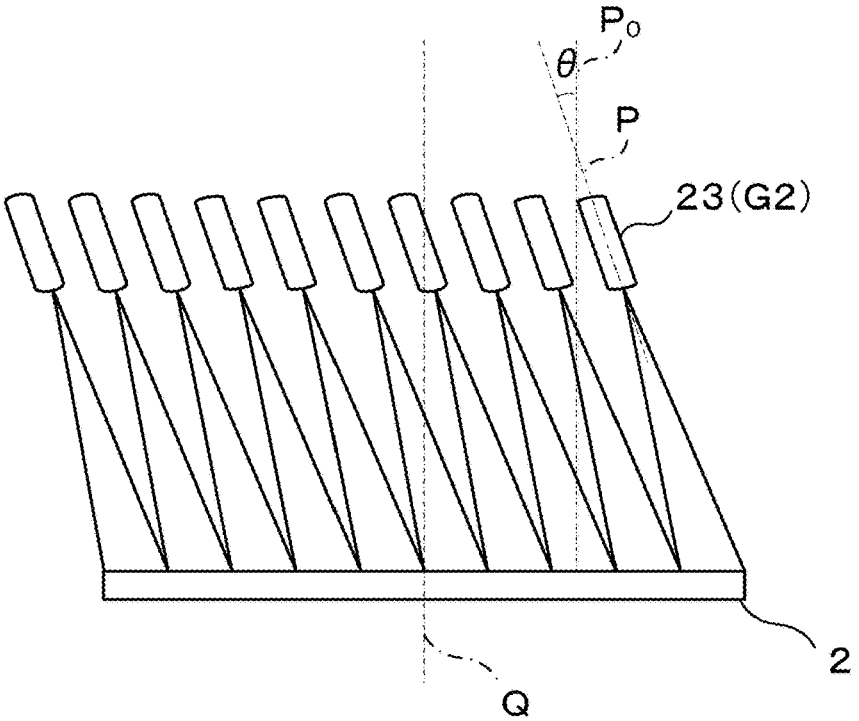

FIG. 14 and FIG. 15(A) and FIG. 15(B) are views explaining another example of the cooling water nozzles 23. FIG. 15(A) illustrates a part of an X-X cross section in FIG. 14, and FIG. 15(B) illustrates a part of a Y-Y cross section in FIG. 14.

In this example, each of the first nozzle groups G1 is provided so that the full width of the cooling width region in the width direction is covered with one first cooling water collision region group RG1, and each of the second nozzle groups G2 is also provided so that the full width of the cooling width region in the width direction is covered with one second cooling water collision region group RG2.

In the case of such a configuration of the nozzle groups, the cooling water nozzles 23 are provided so as to make the centers of the cooling water collision regions R located on the center axis S of the conveyor roll 19 in plan view. Therefore, the sheet passing ability of the hot-rolled steel sheet 2 can be maintained higher. Incidentally, as in this example, in the case where the nozzle groups are provided so that the first cooling water collision region group RG1 and the second cooling water collision region group RG2 each cover the full width of the cooling width region in the width direction, in order to reduce the effect of the water on the sheet, increasing the inclination angle θ of the cooling water nozzles 23 is preferred in comparison to the case where the nozzle groups are provided so that the first cooling water collision region group RG1 and the second cooling water collision region group RG2 described previously each cover one side of the cooling width region in the width direction.

Further, in the case where the cooling water collision regions R are provided as in this example, the first nozzle group G1 and the second nozzle group G2 do not need to be arranged alternately along the steel sheet conveyance direction. The portion consisting of the first nozzle groups G1 or the second nozzle groups G2 that are continuous along the steel sheet conveyance direction may exist, or this example may be configured by only either the first nozzle groups G1 or the second nozzle groups G2.

Second Embodiment

Figure 16:
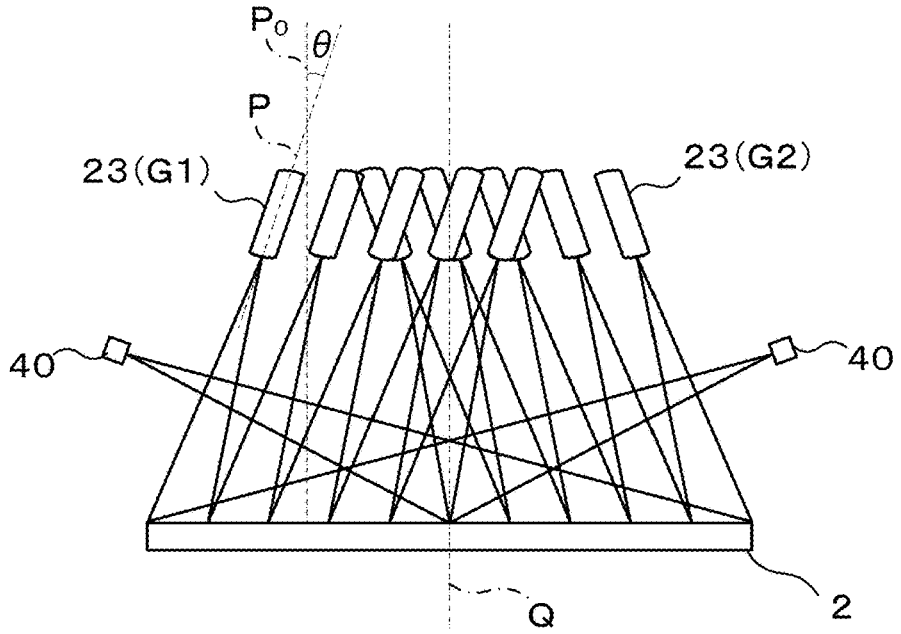
FIG. 16(A) and FIG. 16(B) are views explaining an upper width-direction control cooling device 16 according to a second embodiment.
Figure 16:
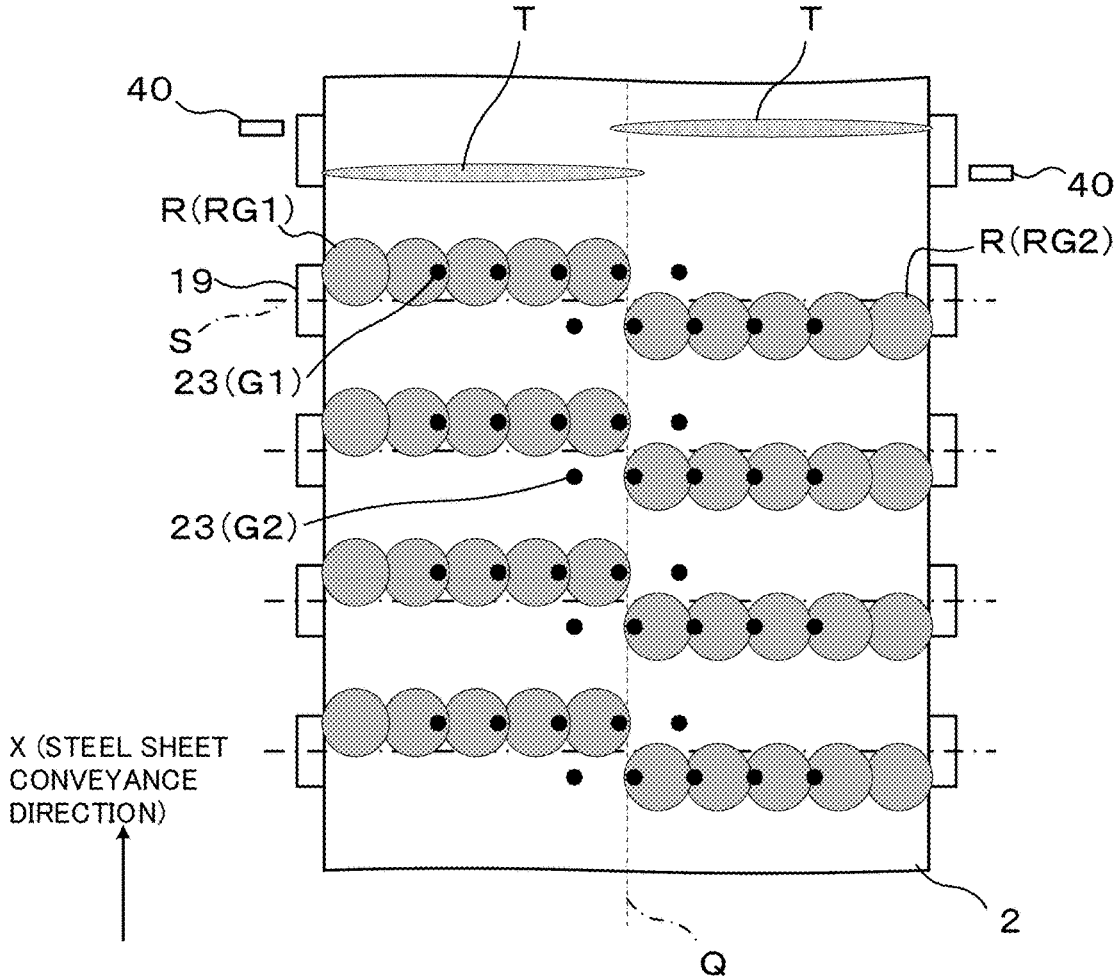

FIG. 16(A) and FIG. 16(B) are views schematically illustrating a part of a configuration of an upper cooling device 16 according to a second embodiment.

The upper cooling device 16 according to this embodiment includes, as illustrated in the drawing, draining nozzles 40, in addition to the configuration of the upper cooling device 16 according to the first embodiment.

The draining nozzles 40 are provided one by one for a region on one side and for a region on the other side of the cooling width region in the width direction. Further, the draining nozzles 40 are provided on the outside of the cooling width region in the width direction, the draining nozzle 40 for the region on one side in the width direction is provided on the outside of the other side in the width direction, and the draining nozzle 40 for the region on the other side in the width direction is provided on the outside of one side in the width direction.

These draining nozzles 40 each jet draining water to a region in the steel sheet conveyance direction downstream from the cooling water collision region group on the most downstream side in the steel sheet conveyance direction to form a downstream draining water collision region T in the conveyance direction.

Although the water on the sheet remains in the region downstream from the cooling region by the cooling water nozzles 23 in some cases, providing the draining nozzles 40 as in this form makes it possible to immediately drain the remaining water on the sheet, resulting in that the hot-rolled steel sheet 2 can be cooled appropriately.

Another Example of the Draining Nozzles 40

Figure 17:
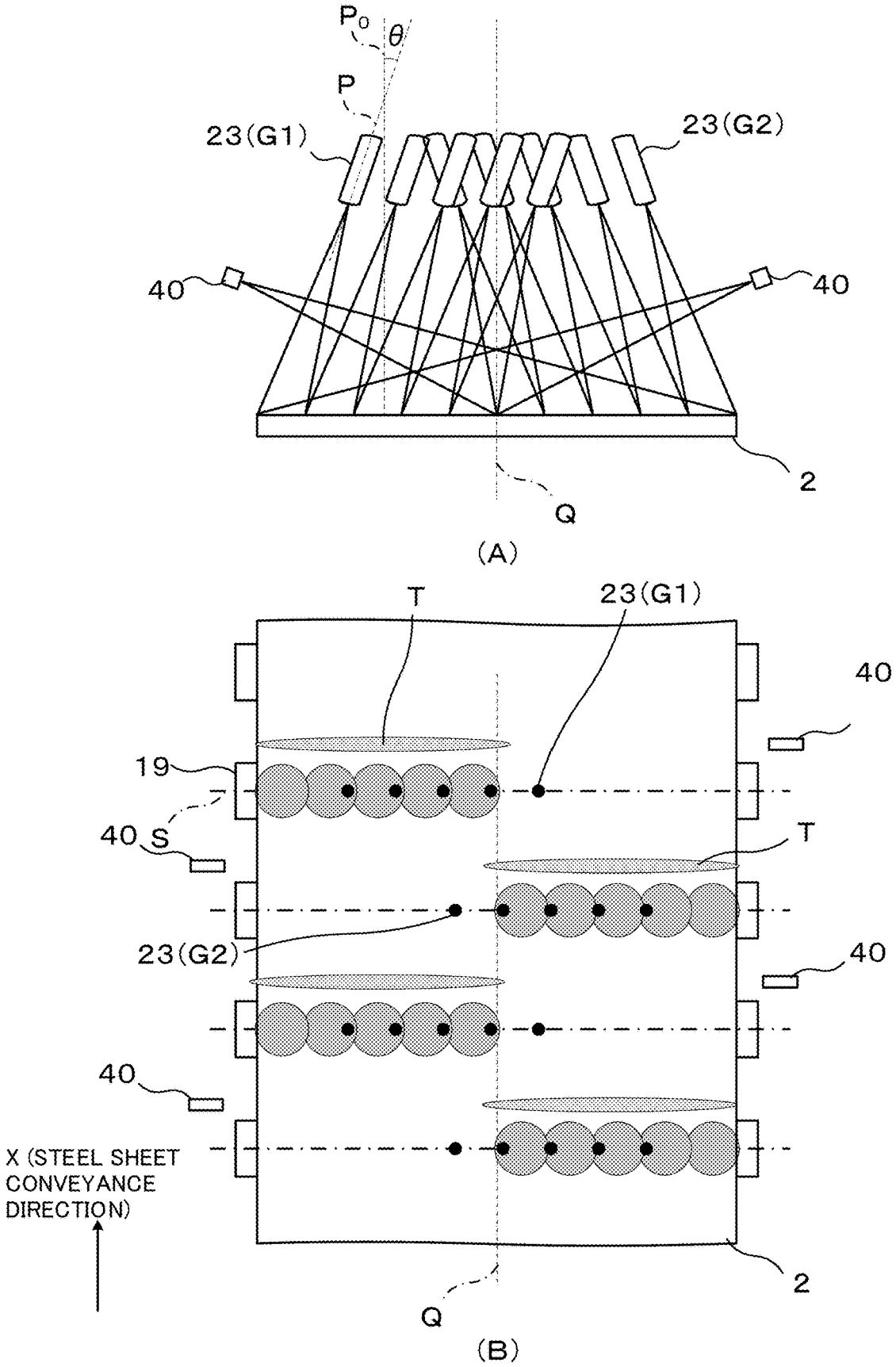
FIG. 17(A) and FIG. 17(B) are views explaining another example of draining nozzles 40.

FIG. 17(A) and FIG. 17(B) are views explaining another example of the draining nozzles 40.

In the example in FIG. 16(A) and FIG. 16(B), the draining nozzles 40 are provided only for the region in the steel sheet conveyance direction downstream from the cooling water collision region group on the most downstream side in the steel sheet conveyance direction. In contrast to this, in the example in FIG. 17(A) and FIG. 17(B), the draining nozzle 40 is provided for each region in the conveyance direction downstream from each of the cooling water collision region groups.

In this example as well, it is possible to immediately drain the water on the sheet remaining in the region downstream from the cooling region by the cooling water nozzles 23, resulting in that the hot-rolled steel sheet 2 can be cooled appropriately.

Modified Examples of the First and Second Embodiments

In the above explanations, the cooling water nozzles 23 are full cone spray nozzles, but are not limited to the full cone spray nozzles that form the circular cooling water collision regions R as long as they are spray nozzles to which a back pressure of about 0.3 MPa is applied, and the cooling water nozzles 23 may also be other nozzles such as flat spray nozzles that form oval cooling water collision regions R.

Incidentally, it is not preferable to use, for the cooling water nozzles 23, laminar nozzles that supply cooling water in bulk flow (namely, laminar flow), such as a bar jet, which is different from the dispersive flow from spray nozzles. This is because, as compared to the case of using spray nozzles, the previously-described return ratio of cooling water from the cooling water nozzles 23 is larger and a large amount of water on the sheet is more likely to remain in the case of using the laminar nozzles. Further, even in the case of using the laminar nozzles, the amount of water on the sheet can be reduced by increasing the inclination angle θ of the jet axis P, but when the above-described inclination angle θ is increased, the kinetic momentum of a vertical component of the cooling water to collide with the hot-rolled steel sheet 2 is weakened and the cooling capacity is weakened. Further, when the above-described inclination angle θ is increased, the flow rate of the water on the sheet increases, and thus, the cooling capacity by the water on the sheet is enhanced and the portion that should not be cooled originally is to be cooled by the water on the sheet eventually. That is, when the above-described inclination angle θ is increased, it is impossible to sufficiently increase the difference in cooling capacity between the collision region and the non-collision of the cooling water. Thus, in the case where the laminar nozzles are used and the above-described inclination angle θ is increased, it is impossible to perform the cooling control as in the previously-described form, namely, perform a control to cool the hot-rolled steel sheet 2 so as to make the temperatures of the hot-rolled steel sheet 2 uniform by switching between collision and non-collision of cooling water for each of the divided cooling surfaces A3. Further, even if the control is performed, the cooling machine length is lengthened. Even if the cooling water nozzles are pipe laminar nozzles or slit-laminar nozzles, the same thing can be said in terms of the above points as long as the cooling water nozzles are laminar nozzles.

Figure 18:
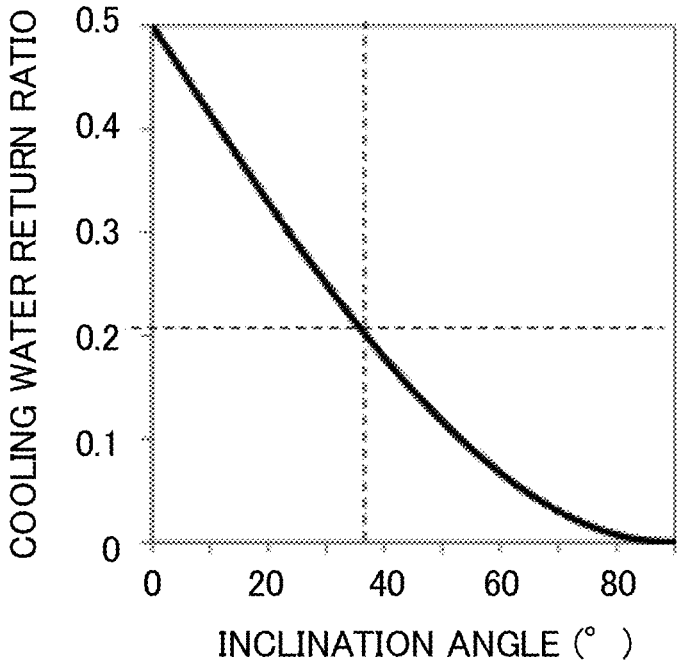
FIG. 18 is a view for explaining an effect obtained when the cooling water nozzle 23 is set as a slit-laminar nozzle.

FIG. 18 is a view explaining a relationship between the inclination angle θ of the jet axis P of the cooling water nozzle 23 and the return ratio of cooling water from the cooling water nozzles 23 in the case of using the slit-laminar nozzles.

In the case of using the full cone nozzles, as illustrated in FIG. 10, it is possible to suppress the return ratio of cooling water from the cooling water nozzles 23 to two or less out of ten by increasing the inclination angle θ of the jet axis P of the cooling water nozzle 23 to 10° or more. In contrast to this, in the case of using the slit-laminar nozzles, as illustrated in FIG. 18, it is impossible to suppress the return ratio of cooling water from the cooling water nozzles 23 to two or less out of ten unless the above-described inclination angle θ is increased to 37° or more.

Further, the pipe laminar nozzles and the slit-laminar nozzles are not preferable as the cooling water nozzles 23 because each gap needs to be provided between the cooling water collision regions adjacent in the width direction, in order to prevent the cooling waters as a laminar flow from interfering with each other.

Figure 19:
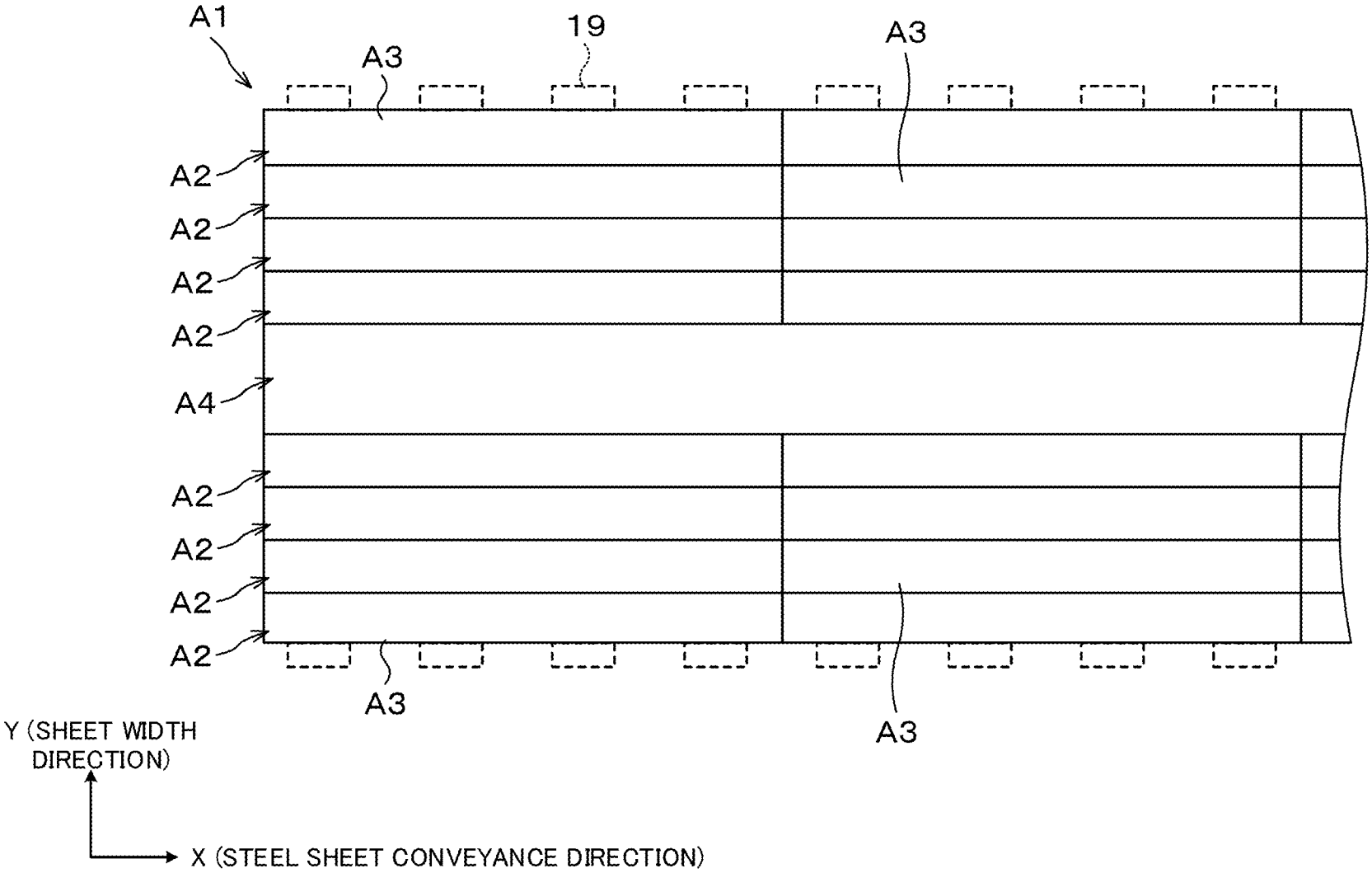
FIG. 19 is a view explaining an entire cooling region A1 of another example.

In the above-described example, the region demarcated by the cooling machine length and the full width of the cooling width region in the width direction is set as the entire cooling region. In place of this, in a certain case, as illustrated in FIG. 19, the region, which is obtained by excluding a non-cooling region A4 in the middle portion in the width direction from the region demarcated by the cooling machine length and the full width of the cooling width region in the width direction, may be set as the entire cooling region A1. The certain case is, for example, the case where a hot rolling sheet-passing guide is provided in the middle portion in the width direction between the conveyor rolls 19 adjacent in the steel sheet conveyance direction in order to prevent the leading end of the hot-rolled steel sheet 2 from falling between the conveyor rolls 19. When the hot rolling sheet-passing guide is provided in the middle portion in the width direction as above, the temperature of the hot-rolled steel sheet in the middle portion in the width direction is sometimes lower than that of the other portion in the width direction due to the cooling water used to protect the guide. In order to prevent such a situation, the middle portion of the cooling width region in the width direction is set as the non-cooling region to achieve the uniformization of the width-direction temperature distribution of the hot-rolled steel sheet 2 in some cases.

Figure 20:
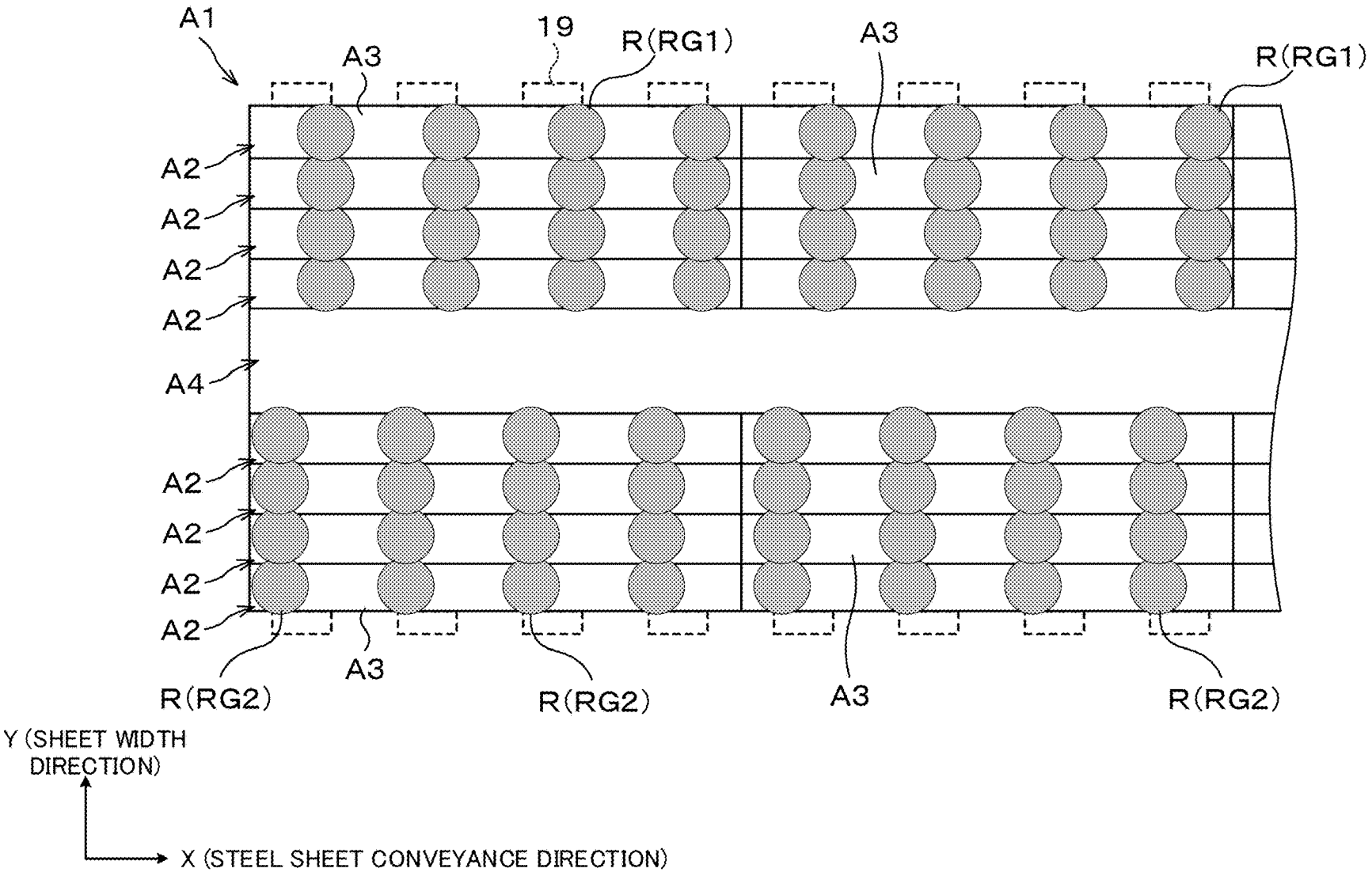
FIG. 20 is a view explaining the cooling water collision regions R formed in the case of the entire cooling region A1 in the example of FIG. 19.

In the case of the entire cooling region A1 resulting from excluding the above-described non-cooling region A4, the first region groups RG1 and the second region groups RG2 are formed in the entire cooling region A1 and are not formed in the non-cooling region A4, as illustrated in FIG. 20. However, in this case as well, the full width of the entire cooling region A1 in the width direction is covered with the first region group RG1 and the second region group RG2 that is adjacent to the first region group RG1 in the steel sheet conveyance direction.

Further, also in the case of the entire cooling region A1 resulting from excluding the non-cooling region A4, as illustrated in FIG. 20, the first region group RG1 and the second region group RG2 may be arranged in a staggered pattern in plan view with respect to the position where the conveyor roll 19 is arranged and the cooling water collision regions R forming each of the region groups may overlap the center axis S of the conveyor roll 19 in plan view, similarly to the example in FIG. 9(B), or the like.

Figure 21:
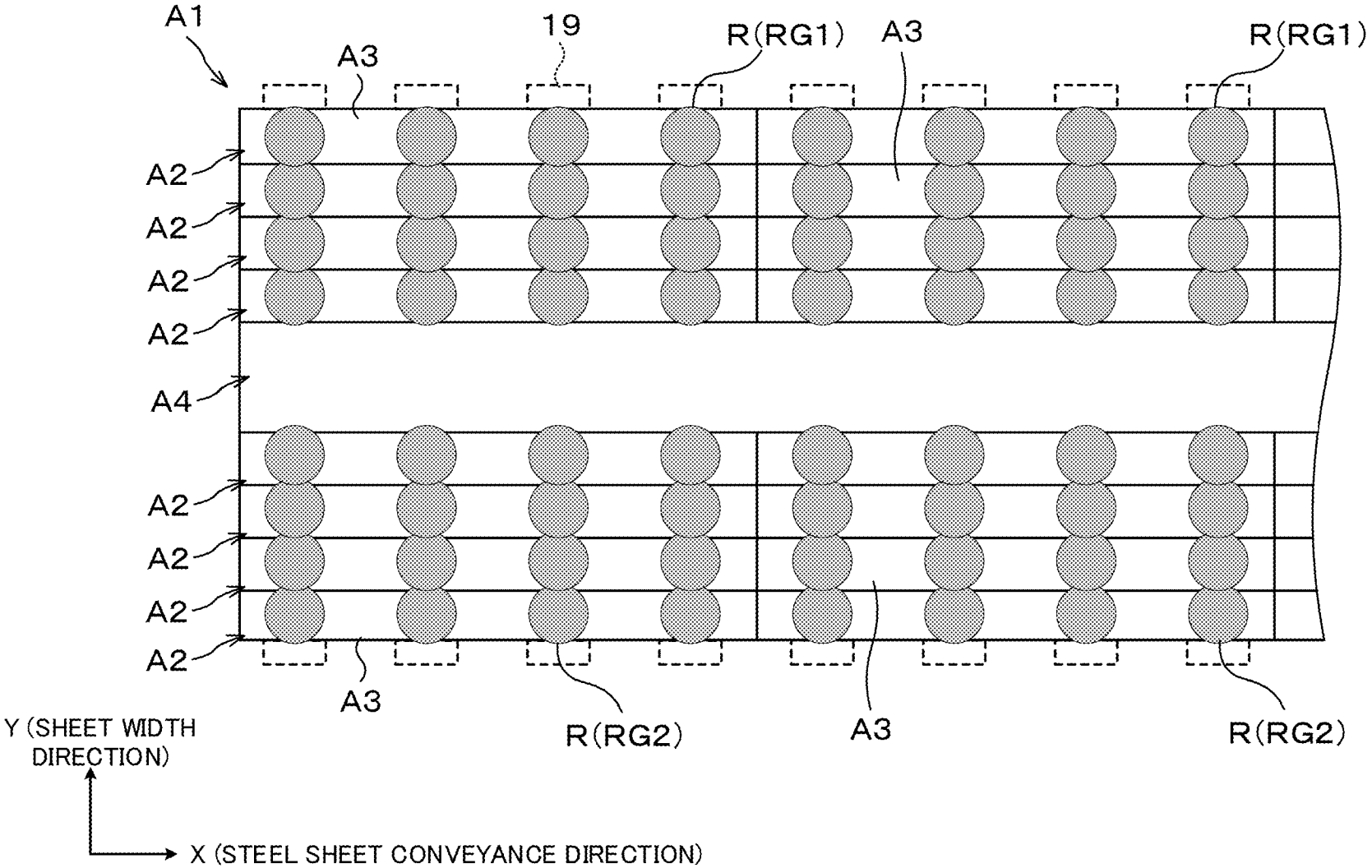
FIG. 21 is a view explaining another example of the cooling water collision regions R formed in the case of the entire cooling region A1 in the example of FIG. 19.

Regardless of this example, as illustrated in FIG. 21, for example, the first region group RG1 and the second region group RG2 both may be set for the single conveyor roll 19 and the centers of the cooling water collision regions R forming each of the region groups may be located on the center axis S of the conveyor roll 19. Incidentally, in this example, the term "a pair of region groups adjacent to each other in the machine length direction" means a "pair of region groups whose positions in the machine length direction coincide with each other."

Further, in the case of the entire cooling region A1 resulting from excluding the non-cooling region A4, when the centers of the cooling water collision regions R are located on the center axis S of the conveyor roll 19, similarly to the example in FIG. 13(B), either the first region group RG1 or the second region group RG2 may be set for the single conveyor roll 19.

Incidentally, also in the case of the entire cooling region A1 resulting from excluding the non-cooling region A4, the cooling water nozzles 23 may be provided directly above the hot-rolled steel sheet 2, or may be provided on the outside of the hot-rolled steel sheet 2 as side sprays. Further, the draining nozzles may be provided.

Figure 22:
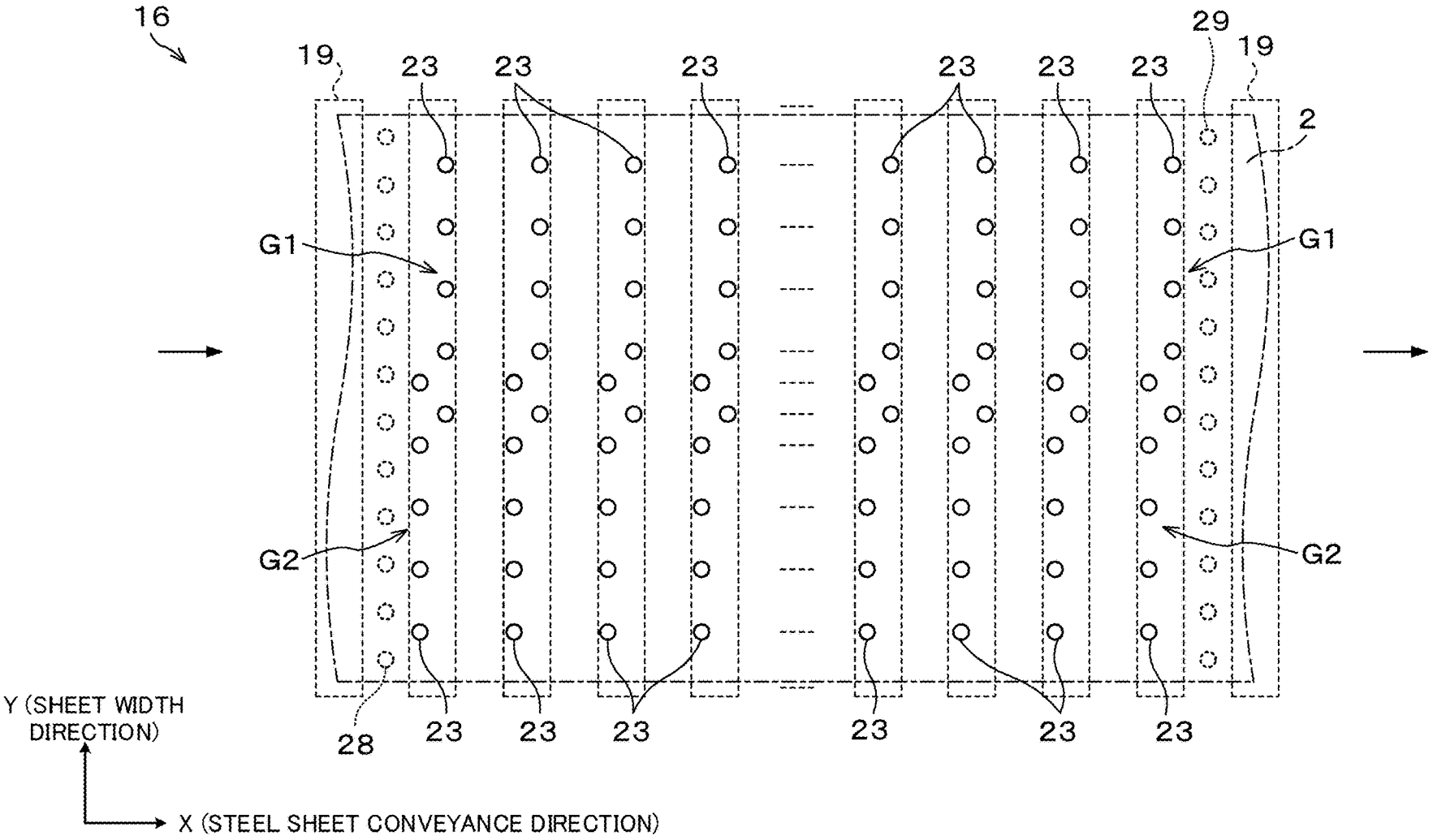
FIG. 22 is a view explaining switching devices of another example.

In the above-described examples, the intermediate headers 24 are provided, but a configuration not including the intermediate headers 24 can also be employed. FIG. 22 illustrates a plan view illustrating an outline of a configuration of an upper cooling device 16 according to this configuration. FIG. 22 is a view corresponding to FIG. 3, where the three-way valve 27 is connected to each one of the cooling water nozzles 23, but for ease of understanding, the illustrations of the three-way valves 27, the water feed header 26, and the drain header are omitted.

In the example in FIG. 22, a not-illustrated pipe is connected to each of the cooling water nozzles 23, and this pipe is provided with the three-way valves. The three-way valve is provided between the water feed header that supplies cooling water to the pipe and the drain header that drains cooling water. Even with such a configuration in which the intermediate headers 24 are omitted, the same effect as that obtained by the configuration including the previously-described intermediate headers 24 can be exhibited.

Further, in order to improve the sheet passing ability, a disk roll that supports the hot-rolled steel sheet 2 from below may be provided between the conveyor rolls 19 adjacent in the steel sheet conveyance direction.

Further, the upper cooling device 16 is arranged downstream of the main cooling device 15, but the place where the upper cooling device 16 is arranged is not limited to this example.

Further, in the above-described explanation, there has been explained, as an example, the form in which the opening and closing of the three-way valve 27 is controlled to switch between collision and non-collision of cooling water with the divided cooling surface. The present invention is not limited to this form, and it is also possible to apply a form in which a flow rate regulating valve is provided between the intermediate header 24 and the three-way valve 27 and a jet flow rate of cooling water from the flow rate regulating valve is controlled to switch between collision and non-collision of the cooling water with the divided cooling surface, for example. However, from the viewpoint of responsivity, or the like, the form in which the opening and closing of the three-way valve 27 is controlled is more preferable.

Hitherto, the embodiments of the present invention have been explained, but the present invention is not limited to the above examples. It is obvious that those skilled in the art could arrive at various changed examples or modified examples within the scope of the technical idea defined in the claims, and they are naturally understood as belonging to the technical scope of the present invention.

EXAMPLES

Hereinafter, there will be explained the effects of the present invention based on examples and comparative examples. However, the present invention is not limited to these examples.

Example 1 and Comparative Example 1

In order to verify the effects, in Example 1, a cooling device consisting of the main cooling device 15, the upper cooling device 16, and the adjustment cooling device 17 in FIG. 1 was used to perform cooling. Further, in Comparative example 1, a cooling device consisting of the main cooling device 15 and the adjustment cooling device 17, excluding the upper cooling device 16, was used to perform cooling. In Example 1 and Comparative example 1, cooling in the main cooling device 15 was performed by feedback control based on measurement results obtained by not-illustrated temperature sensors provided downstream of the main cooling device 15, and cooling in the adjustment cooling device 17 was also performed by feedback control based on measurement results obtained by not-illustrated temperature sensors provided downstream of the adjustment cooling device 17 in the same manner.

Further, Example 1 and Comparative example 1 were set as follows: steel sheet width: 1600 mm, sheet thickness: 2.0 mm, steel sheet conveying speed: 600 mpm, temperature before cooling: 900° C., target coiling temperature: 550° C.

The structure of the upper cooling device 16 according to Example 1 was the same as that illustrated in FIG. 9(A) and FIG. 9(B). Further, as illustrated in FIG. 5, or the like, the entire cooling region A1 did not contain the non-cooling region A4 in FIG. 19. Then, the number of width-divided cooling zones A2 was set to eight. That is, the length of the divided cooling surface A3 in the width direction was set to the length of the entire cooling region A1 divided into 8 equal portions in the width direction. Further, the first nozzle group G1 jetted cooling water to, out of the divided cooling surfaces A3, four divided cooling surfaces A3 on one side in the width direction, and the second nozzle group G2 jetted cooling water to, out of the divided cooling surfaces A3, four divided cooling surfaces A3 on the other side in the width direction. The length of the divided cooling surface A3 in the steel sheet conveyance direction was set to the length for four pitches between rolls in the steel sheet conveyance direction. Further, the number of divided cooling surfaces A3 in the steel sheet conveyance direction was set to three. That is, 24 divided cooling surfaces A3, which mean eight (the number in the width direction)×three (the number in the steel sheet conveyance direction), are provided, and in other words, 24 cooling units including the cooling water nozzles 23, which mean eight (the number in the width direction)× three (the number in the steel sheet conveyance direction), are provided. The height of the cooling water nozzle 23, concretely, the height from the top surface of the hot-rolled steel sheet 2 to the tip of the cooling water nozzle 23, was set to 1.1 m, and the inclination angle θ of the cooling water nozzle 23 was set to 15°. Further, in order to prevent the interference between cooling water from the cooling water nozzles 23 of the first nozzle group G1 and cooling water from the cooling water nozzles 23 of the second nozzle group G2, the positions of the centers of the cooling water collision regions R from the cooling water nozzles 23 were slightly shifted to the upstream side or the downstream side from directly above the center axis S of the conveyor roll 19 as illustrated in FIG. 9(B), or the like. As the cooling water nozzles 23, full cone nozzles with a cooling water volume of 186 liters per minute per one piece were used. The pitch of the cooling water nozzles 23 and the pitch of the cooling water collision regions R in the width direction were set to 200 mm. The temperature drop per one unit of the above-described cooling units provided for the respective divided cooling surfaces A3 is about 15° C. Incidentally, in Example 1 and Comparative example 1, the lower cooling device was not installed at the position facing the upper cooling device 16 or at the position corresponding to this position.

Figure 23:
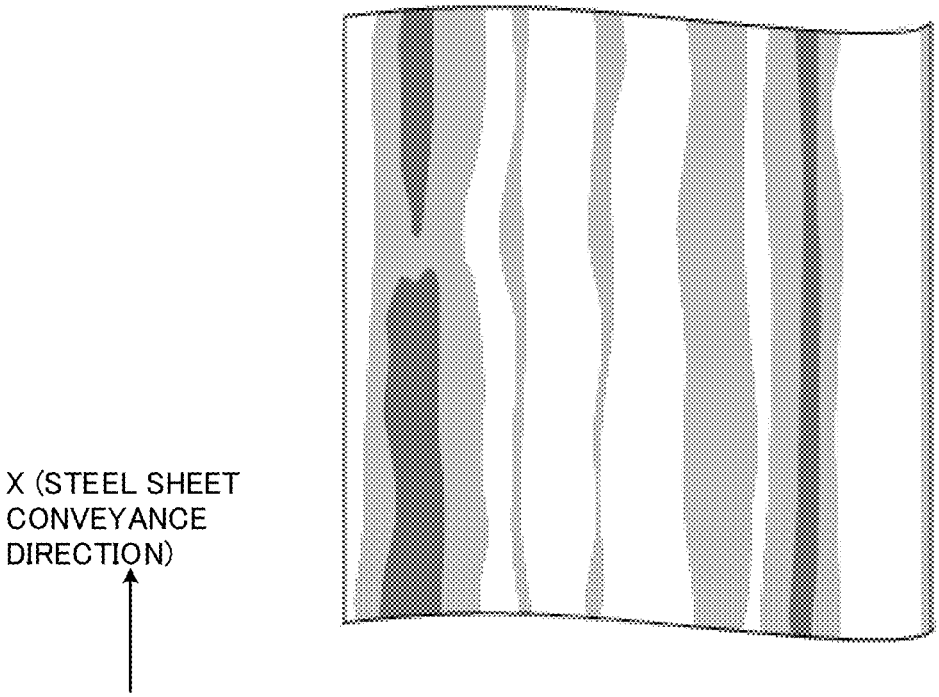
FIG. 23(A) and FIG. 23(B) are views illustrating a part of a steel sheet temperature distribution in a comparative example and an example.
Figure 23:
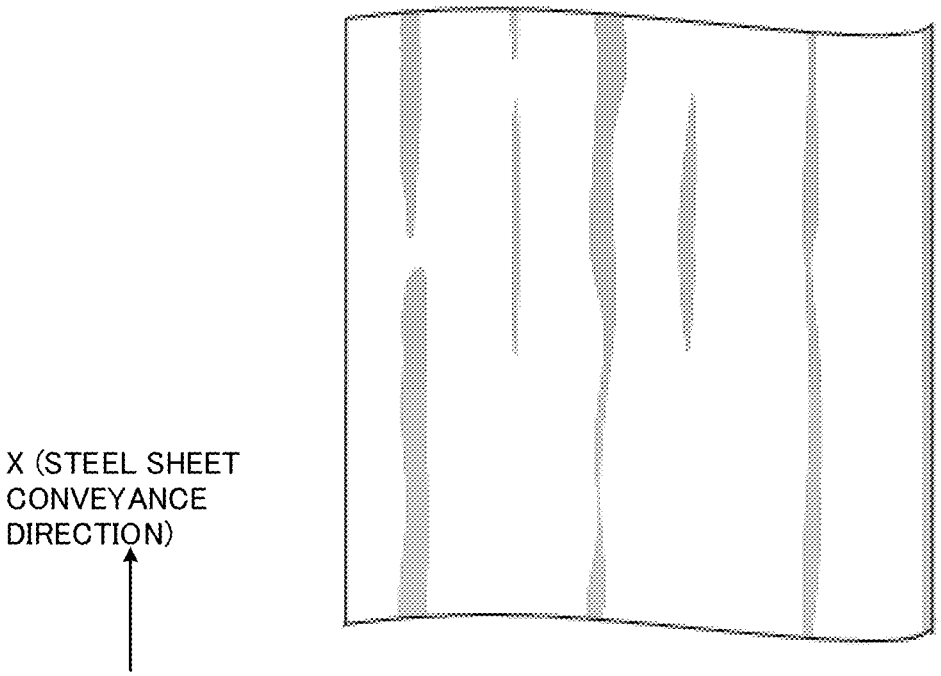

FIG. 23(A) and FIG. 23(B) are views illustrating a part of a temperature distribution of the coiling temperature of the hot-rolled steel sheet 2 in Example 1 and Comparative example 1, and FIG. 23(A) and FIG. 23(B) illustrate the temperature distributions in Comparative example 1 and Example 1 respectively. Incidentally, in the drawings, the distribution where the absolute value of a temperature difference compared to the target temperature is within 20° C. was illustrated in white, the portion where the absolute value is greater than 20° C. and within 40° C. was illustrated in light gray, and the portion where the absolute value is greater than 40° C. was illustrated in dark gray.

As illustrated in FIG. 23(A), in Comparative example 1, streak-shaped temperature variations due to temperature deviations induced by facility poor maintenance or the like, occur, and there are present some portions having a temperature higher than the target temperature. Further, in Comparative example 1, the standard temperature deviation was 25.7° C. The standard temperature deviation in Comparative example 1 was found from the results measured by an infrared temperature image measuring device with all the measurement points of the temperature of the steel sheet, excluding a 100-m leading end and a 100-m tail end of the steel sheet, (which is due to excluding free tension portions), and both 50-mm ends of the steel sheet in the width direction.

In the meantime, as illustrated in FIG. 23(B), in Example 1, the portion having a temperature higher than the target temperature is much smaller than in Comparative example 1. Then, when the illustrated hot-rolled steel sheet was cooled, the standard temperature deviation was as very small as 16.5° C. in Example. The standard temperature deviation in Example 1 was found from the temperatures of the steel sheet excluding a 100-m leading end and a 100-m tail end of the steel sheet and both 50-mm ends of the steel sheet.

Thus, according to the present invention, it was found out that the temperatures of the hot-rolled steel sheet 2 in the width direction can be made uniform.

Examples 2 to 4 and Comparative Examples 2 to 4

TABLE 1

| | NOZZLE | INCLINATION ANGLE [°] | LAP LENGTH [mm] | STANDARD TEMPERATURE DEVIATION [° C.] | TEMPERATURE VARIATION EVALUATION | COLLISION PRESSURE INDEX [—] | COOLING CAPACITY EVALUATION |
|---|---|---|---|---|---|---|---|
| EXAMPLE 2 | FULL CONE | 15 | 20 mm | 16.5 | ○ | 0.97 | ○ |
| EXAMPLE 3 | FULL CONE | 30 | 20 mm | 15.7 | ○ | 0.87 | ○ |
| EXAMPLE 4 | FULL CONE | 60 | 20 mm | 15.6 | ○ | 0.50 | Δ |
| COMPARATIVE EXAMPLE 2 | FULL CONE | 0 | 20 mm | 22.2 | X | 1.0 (REFERENCE) | ○ |
| COMPARATIVE EXAMPLE 3 | PIPE LAMINAR (JET) | 50 | — | 20.1 | X | 0.64 | Δ |
| COMPARATIVE EXAMPLE 4 | PIPE LAMINAR | 0 | — | 21.5 | X | 1.0 (REFERENCE) | ○ |

In Examples 2 to 4, similarly to Example 1, cooling was performed by using the cooling device consisting of the main cooling device 15, the upper cooling device 16, and the adjustment cooling device 17 in FIG. 1. Further, the height of the cooling water nozzles 23 was set to 1.1 m. Then, the pitch of the cooling water nozzles 23 and the pitch of the cooling water collision regions R in the width direction were set to 200 mm. Further, the width of a region where the cooling water collision regions R adjacent to each other in the width direction, which form each cooling water collision region group, overlap with each other in the width direction (to be referred to as a "lap length of the cooling water collision regions R" below) was set to 20 mm. In Examples 2, 3, and 4, as illustrated in Table 1, as the cooling water nozzles 23, full cone nozzles were used, and the inclination angle θ of the jet axis P of the cooling water nozzle 23 was set to 15°, 30°, and 60°. The other conditions of Examples 2 to 4 are the same as those in Example 1.

In the meantime, in Comparative example 2, as the cooling water nozzles 23, full cone nozzles were used, and the inclination angle θ of the jet axis P was set to 0°. The other conditions of Comparative example 2 are the same as those in Example 2.

Further, in Comparative example 3, as the cooling water nozzles 23, pipe laminar nozzles that supply cooling water in a high flow density bar jet (jet flow) were used, and the inclination angle θ of the jet axis P was set to 50°.

In Comparative example 4, as the cooling water nozzles 23, pipe laminar nozzles that supply cooling water in free-fall flow were used. Incidentally, due to the free-fall flow, the inclination angle θ of the jet axis P was 0°. Further, in Comparative examples 3, 4 as well, the lower cooling device was not installed at the position facing the upper cooling device 16.

Incidentally, in Comparative example 3, the pitch of the cooling water nozzles 23 in the width direction was set to 60 m, and the nozzle diameter was set to 7 mm. In Comparative example 4, the pitch of the cooling water nozzles 23 in the width direction was set to 60 m, and the nozzle diameter was set to 15 mm Incidentally, in Comparative example 3 and Comparative example, 4, the cooling water collision region R formed by the cooling water nozzle 23 does not overlap another cooling water collision region R adjacent thereto in the width direction. This is because when they overlap, the cooling waters in laminar flow interfere with each other. Further, in Comparative example 3 and Comparative example 4, a cooling water volume per one cooling water nozzle 23 is 73 L/min. and 67 L/min. Incidentally, although in Comparative example 3 and Comparative example 4 using the pipe laminar nozzles, the cooling water volume per one cooling water nozzle 23 is larger as compared to Examples 2 to 4 and Comparative example 2, the total cooling water volume is smaller as compared to Examples 2 to 4 and Comparative example 2 using the spray nozzles because the pitch of the cooling water nozzles 23 is narrow and the number of cooling water nozzles 23 is large.

As illustrated in Table 1, in Comparative example 2 in which as the cooling water nozzles 23, the full cone nozzles were used and were not inclined with the inclination angle θ of the jet axis P being 0°, the standard temperature deviation was as high as 22.2° C. In contrast to this, in Examples 2 to 4 in which as the cooling water nozzles 23, the full cone nozzles were used and were inclined with the inclination angle θ of the jet axis P being greater than 0°, the standard temperature deviation was as very small as 15.6° C. to 16.5° C. Particularly, in Examples 2, 3 in which the cooling water nozzles 23 had the inclination angle θ of the jet axis P falling within a range of 10° to 45°, the collision pressure index was also 0.7 or more and the cooling capacity was also high.

Further, in Comparative examples 3, 4 in which the pipe laminar nozzles were used as the cooling water nozzles 23, the standard temperature deviation was as large as 20° C. or more. As in Comparative example 3, in particular, even in the case where the water volume density of the cooling water from the cooling water nozzle 23 was high, the inclination angle θ of the jet axis P was as large as 50°, and no water remained on the sheet, the standard temperature deviation was 20° C. or more.

Examples 2, 5, 6 and Comparative Examples 5, 6

TABLE 2

| | NOZZLE | INCLINATION ANGLE [°] | LAP LENGTH [mm] | STANDARD TEMPERATURE DEVIATION [° C.] | TEMPERATURE VARIATION EVALUATION |
|---|---|---|---|---|---|
| EXAMPLE 2 | FULL CONE | 15 | 20 mm | 16.5 | ○ |
| EXAMPLE 5 | FULL CONE | 15 | 10 mm | 16.7 | ○ |
| EXAMPLE 6 | FULL CONE | 15 | 0 mm | 18.2 | ○ |
| COMPARATIVE EXAMPLE 5 | FULL CONE | 15 | −10 mm | 20.3 | X |
| COMPARATIVE EXAMPLE 6 | FULL CONE | 15 | −20 mm | 23.6 | X |

In Example 2, as described previously, the lap length of the cooling water collision regions R was set to 20 mm. In contrast to this, in Examples 5, 6, the above-described lap length was set to 10 mm and 0 mm respectively. Further, in Comparative examples 5, 6, the lap length of the cooling water collision regions R was set to −10 mm and −20 mm respectively. That is, in Comparative examples 5, 6, each gap was provided between the cooling water collision regions R adjacent to each other in the width direction, which form each cooling water collision region group. The other conditions of Examples 5, 6 and Comparative examples 5, 6 are the same as those in Example 2.

As illustrated in Table 2, in Comparative examples 5, 6, the standard temperature deviation was as large as 20.3° C. and 23.6° C., in Example 6, the standard temperature deviation was as low as 18.2° C., and in Examples 2, 5, the standard temperature deviation was further as low as 16.5° C. and 16.7° C. This reveals that the cooling water collision regions R adjacent to each other in the width direction, which form each cooling water collision region group, need to be overlapped, the temperatures of the hot-rolled steel sheet 2 can be made more uniform as long as the lap length of the cooling water collision regions is at least 10 mm or more, and the temperatures of the hot-rolled steel sheet 2 can be made more uniform when the lap length of the cooling water collision regions R is larger. Incidentally, 10 mm, which is the lap length of the cooling water collision regions R, is equivalent to 5% of the width of one cooling water collision region R in the width direction.

Examples 2, 7 to 11

TABLE 3

| | NOZZLE | INCLINATION ANGLE [°] | LAP LENGTH [mm] | STANDARD TEMPERATURE DEVIATION [° C.] | TEMPERATURE VARIATION EVALUATION | LOWER COOLING |
|---|---|---|---|---|---|---|
| EXAMPLE 2 | FULL CONE | 15 | 20 mm | 16.5 | ○ | — |
| EXAMPLE 7 (FIG. 12(A) AND FIG. 12(B)) | FULL CONE | 45 | 20 mm | 17.8 | ○ | — |
| EXAMPLE 8 (FIG. 13(A) AND FIG. 13(B)) | FULL CONE | 15 | 20 mm | 17.2 | ○ | — |
| EXAMPLE 9 (FIG. 14) | FULL CONE | 15 | 20 mm | 18.9 | ○ | — |
| EXAMPLE 10 (FIG. 16(A) AND FIG. 16(B)) | FULL CONE | 15 | 20 mm | 16.8 | ○ | — |
| EXAMPLE 11 | FULL CONE | 15 | 20 mm | 16.5 | ○ | PIPE LAMINAR |

As described previously, in Example 2, the cooling water nozzles 23 were provided at such positions as illustrated in FIG. 9(A) and FIG. 9(B). In contrast to this, in Example 7, the cooling water nozzles 23 were provided at such positions as illustrated in FIG. 12(A) and FIG. 12(B), and the inclination angle θ of the jet axis P was set to 45°. Further, in Example 8, the cooling water nozzles 23 were provided at such positions as illustrated in FIG. 13(A) and FIG. 13(B), and in Example 9, the cooling water nozzles 23 were provided at such positions as illustrated in FIG. 14 and FIG. 15(A) and FIG. 15(B). In Example 10, as illustrated in FIG. 16(A) and FIG. 16(B), the cooling water nozzles 23 and the draining nozzles 40 were provided. The other conditions in Examples 6 to 10 are the same as those in Example 2.

Further, Example 11 is different from Example 2 only in that the lower cooling device was installed at the position facing the upper cooling device 16. Incidentally, in the above-described lower cooling device used in Example 11, the pipe laminar nozzles as the cooling water nozzles were aligned in the width direction between the conveyor rolls so as to face the under surface of the hot-rolled steel sheet 2 over the full width of the hot-rolled steel sheet 2, and the cooling water volumes of these nozzles were made constant regardless of the width-direction temperature distribution of the hot-rolled steel sheet 2.

As illustrated in Table 3, in Example 7 as well, the standard temperature deviation was as low as 17.8° C. That is, with the cooling water nozzles 23 in the configuration in FIG. 912(A) and FIG. 12(B), the temperatures of the hot-rolled steel sheet 2 can be made uniform while increasing the degree of freedom of arrangement of the cooling water nozzles 23.

Further, in Example 8 and Example 9 as well, the standard temperature deviation was as low as 17.2° C. and 18.9° C. That is, with the cooling water nozzles 23 in the configuration in FIG. 13(A) and FIG. 13(B) and the cooling water nozzles 23 in the configuration in FIG. 14, the temperatures of the hot-rolled steel sheet 2 can be made uniform while ensuring the sheet passing ability.

Further, even in Example 10, namely, even in the configuration with such draining nozzles 40 as illustrated in FIG. 16(A) and FIG. 16(B) being provided, the standard temperature deviation was as low as 16.8° C. The standard temperature deviation is higher as compared to Example 2 without the draining nozzles 40 being provided, but is a very low value. Further, the configuration in which the draining nozzles 40 are provided as illustrated in FIG. 16(A) and FIG. 16(B) also has the merits that a drainage property on the downstream side of the present cooling device is good and measurement devices such as a thermometer can be installed very close to the downstream side. That is, by providing the draining nozzles 40, the temperatures of the hot-rolled steel sheet 2 can be made uniform while enjoying the above-described merits.

Furthermore, even in Example 11, namely, even in the configuration in which the lower cooling device was provided at the position facing the upper cooling device 16, the standard temperature deviation was the same as that of the case where the lower cooling device was not provided at the position facing the upper cooling device 16. That is, with the use of the upper cooling device 16, the temperatures of the hot-rolled steel sheet 2 in the width direction can be made uniform, regardless of whether or not the lower cooling device is provided at the position facing the upper cooling device 16.

INDUSTRIAL APPLICABILITY

The present invention is useful for the technique to cool hot-rolled steel sheets.

EXPLANATION OF CODES

1 slab
2 hot-rolled steel sheet
10 hot rolling facility
11 heating furnace
12 width-direction mill
13 roughing mill
14 finishing mill
15 main cooling device
16 upper width-direction control cooling device
17 adjustment cooling device
18 coiling device
19 conveyor roll
23 cooling water nozzle
24 intermediate header
25 pipe
26 water feed header
27 three-way valve
28 upstream-side temperature measuring device
29 downstream-side temperature measuring device
30 control device
40 draining nozzle
A1 entire cooling region
A2 width-divided cooling zone
A3 divided cooling surface
A4 non-cooling region
G1 first nozzle group
G2 second nozzle group
$P_0$ vertical line to top surface of cooling width region
P1 jet axis
Q middle in width direction
R cooling water collision region
RG1 first cooling water collision region group
RG2 second cooling water collision region group
S center axis of conveyor roll
T draining water collision region

What is claimed is:

1. A cooling method of a hot-rolled steel sheet that uses a cooling device including a table having a cooling target region to cool a top surface of a hot-rolled steel sheet conveyed on conveyor rolls after hot rolling, wherein the cooling target is a region demarcated by a cooling machine length and a full width in a width direction, or a region obtained by excluding a non-cooling region in a middle portion in the width direction from the demarcated region and is set as an entire cooling region, and wherein the cooling target region includes regions obtained by dividing the entire cooling region into three or more portions in the width direction which are set as width-divided cooling zones, and regions obtained by dividing the width-divided cooling zone into a plurality of portions in a machine length direction which are set as divided cooling surfaces, the cooling device includes:

for each of the divided cooling surfaces, at least one cooling water nozzle that jets cooling water to the divided cooling surface to form a cooling water collision region on the top surface of the cooling target region, the cooling water collision region overlaps an other cooling water collision region adjacent thereto in the width direction in the entire cooling region to form a cooling water collision region group in which the cooling water collision regions are connected in the width direction, each of the cooling water collision region groups does not overlap an other cooling water collision region group, the full width of the entire cooling region in the width direction is covered with the cooling water collision region group or a pair of the cooling water collision region groups adjacent to each other in the machine length direction, and the cooling water nozzles forming the cooling water collision region group have a jet axis inclined with respect to a vertical line to the top surface of the cooling target region when viewed in the machine length direction, and none of the cooling water nozzles forming the cooling water collision group has the jet axis inclined in the opposite direction when viewed in the machine length direction, the cooling method comprising:

measuring a width-direction temperature distribution of the cooling target region;

controlling, for each of the width-divided cooling zones, collision and non-collision of cooling water from the cooling water nozzle with each of a plurality of the divided cooling surfaces contained in the width-divided cooling zone based on measurement results of the width-direction temperature distribution of the cooling target region, thereby controlling cooling for the entire length of the width-divided cooling zone in the machine length direction, and controlling cooling of the entire cooling region; and letting cooling water jetted from the cooling water nozzle go to the side opposite to the cooling water nozzle in the width direction to drain the cooling water.

2. The cooling method of the hot-rolled steel sheet according to claim 1, wherein the non-cooling region is not present.

3. The cooling method of the hot-rolled steel sheet according to claim 1, wherein a width of a region in the width direction where the cooling water collision region overlaps an other cooling water collision region adjacent in the width direction is 5% or more of a width of the cooling water collision region in the width direction.

4. The cooling method of the hot-rolled steel sheet according to claim 1, wherein an inclination angle of the jet axis of the cooling water nozzle is 10° to 45°.

5. The cooling method of the hot-rolled steel sheet according to claim 1, wherein the jet axis of the cooling water nozzle is not inclined in the machine length direction.

6. The cooling method of the hot-rolled steel sheet according to claim 1, wherein the cooling water nozzle is provided so that the cooling water collision region is formed in a region overlapping a center axis of the conveyor roll in plan view.

7. The cooling method of the hot-rolled steel sheet according to claim 6, wherein the cooling water nozzle is provided so as to make the center of the cooling water collision region located on the center axis of the conveyor roll in plan view.

8. The cooling method of the hot-rolled steel sheet according to claim 1, wherein the cooling water nozzle is provided above or on the lateral side of the cooling target region when viewed in the machine length direction.

9. The cooling method of the hot-rolled steel sheet according to claim 1, wherein when the cooling water collision region group formed by the cooling water nozzles that jet cooling water to one side in the width direction is set as a first cooling water collision region group, and the cooling water collision region group formed by the cooling water nozzles that jet cooling water to the other side in the width direction is set as a second cooling water collision region group, the cooling water nozzles are provided so that the first cooling water collision region group and the second cooling water collision region group are both formed and a boundary between the first cooling water collision region group and the second cooling water collision region group in the width direction is located in the middle of the cooling target region in the width direction.

10. The cooling method of the hot-rolled steel sheet according to claim 1, further comprising:

jetting draining water to form a draining water collision region, on the top surface of the cooling target region, in each region on the downstream side of each of the cooling water collision region groups in the machine length direction, or in a region in the machine length direction downstream from, out of the cooling water collision region groups, the region group on the most downstream side in the machine length direction.

11. A cooling device for a hot-rolled steel sheet that cools a top surface of a hot-rolled steel sheet conveyed on conveyor rolls after hot rolling, the cooling device comprising:

a table having a cooling target region, wherein the cooling target region is a region demarcated by a cooling machine length and a full width in a width direction, or a region obtained by excluding a non-cooling region in a middle portion in the width direction from the demarcated region and is set as an entire cooling region, and wherein the cooling target region includes regions obtained by dividing the entire cooling region into three or more portions in the width direction which are set as width-divided cooling zones, and regions obtained by dividing the width-divided cooling zone into a plurality of portions in a machine length direction which are set as divided cooling surfaces, at least one cooling water nozzle that jets cooling water to each of the divided cooling surfaces to form a cooling water collision region on the top surface of the cooling target region and a switching device that switches between collision and non-collision of the cooling water jetted from the cooling water nozzle with the divided cooling surface, the cooling water nozzle and the switching device provided for each of the divided cooling surfaces;

a temperature detecting device that measures a width-direction temperature distribution of the cooling target region; and a control device that controls operation of the switching device corresponding to each of a plurality of the divided cooling surfaces contained in the width-divided cooling zone for each of the width-divided cooling zones based on measurement results of the width-direction temperature distribution by the temperature detecting device, to thereby control cooling for the entire length of the width-divided cooling zone, and controls cooling of the entire cooling region with these controls together, wherein the cooling water collision region overlaps an other cooling water collision region adjacent thereto in the width direction in the entire cooling region to form a cooling water collision region group in which the cooling water collision regions are connected in the width direction, each of the cooling water collision region groups does not overlap an other cooling water collision region group, the full width of the entire cooling region in the width direction is covered with the cooling water collision region group or a pair of the cooling water collision region groups adjacent to each other in the machine length direction, and the cooling water nozzles forming the single cooling water collision region group have a jet axis inclined with respect to a vertical line to the top surface of the cooling target region when viewed in the machine length direction, and none of the cooling water nozzles forming the cooling water collision group has the jet axis inclined in the opposite direction when viewed in the machine length direction.

12. The cooling device for the hot-rolled steel sheet according to claim 11, wherein the non-cooling region is not present.

13. The cooling device for the hot-rolled steel sheet according to claim 11, wherein a width of a region in the width direction where the cooling water collision region overlaps an other cooling water collision region adjacent in the width direction is 5% or more of a width of the cooling water collision region in the width direction.

14. The cooling device for the hot-rolled steel sheet according to claim 11, wherein an inclination angle of the jet axis of the cooling water nozzle is 10° to 45°.

15. The cooling device for the hot-rolled steel sheet according to claim 11, wherein the jet axis of the cooling water nozzle is not inclined in the machine length direction.

16. The cooling device for the hot-rolled steel sheet according to claim 11, wherein the cooling water collision region overlaps a center axis of the conveyor roll in plan view.

17. The cooling device for the hot-rolled steel sheet according to claim 16, wherein the cooling water nozzle is provided to make the center of the cooling water collision region located on the center axis of the conveyor roll in plan view.

18. The cooling device for the hot-rolled steel sheet according to claim 11, wherein the cooling water nozzle is provided above or on the lateral side of the cooling target region when viewed in the machine length direction.

19. The cooling device for the hot-rolled steel sheet according to claim 11, wherein when the cooling water collision region group formed by the cooling water nozzles that jet cooling water to one side in the width direction is set as a first cooling water collision region group, and the cooling water collision region group formed by the cooling water nozzles that jet cooling water to the other side in the width direction is set as a second cooling water collision region group, the cooling water nozzles are provided so that the first cooling water collision region group and the second cooling water collision region group are both formed and a boundary between the first cooling water collision region group and the second cooling water collision region group in the width direction is located in the middle of the cooling target region in the width direction.

20. The cooling device for the hot-rolled steel sheet according to claim 11, further comprising:

a draining nozzle that jets draining water to form a draining water collision region is provided, on the top surface of the cooling target region, in each region on the downstream side of each of the cooling water collision region groups in the machine length direction, or in a region in the machine length direction downstream from, out of the cooling water collision region groups, the region group on the most downstream side in the machine length direction.

* * * * *